US006676276B2

(12) United States Patent
Stephens

(10) Patent No.: US 6,676,276 B2
(45) Date of Patent: Jan. 13, 2004

(54) BLACK LIGHT DISPLAY DEVICE

(76) Inventor: Peter Stephens, 753 39th Ave., San Francisco, CA (US) 94121

( * ) Notice: Subject to any disclaimer, the term of this patent is extended or adjusted under 35 U.S.C. 154(b) by 0 days.

(21) Appl. No.: 09/943,345

(22) Filed: Aug. 30, 2001

(65) Prior Publication Data

US 2003/0048637 A1 Mar. 13, 2003

(51) Int. Cl.[7] ..... G09F 19/02

(52) U.S. Cl. ..... 362/260; 362/84; 362/322; 362/282; 362/806

(58) Field of Search ..... 362/260, 84, 280, 362/282, 283, 284, 322, 323, 324, 806; 40/431

(56) References Cited

U.S. PATENT DOCUMENTS 3,791,058 A * 2/1974 Mollica ..... 40/33
4,008,534 A * 2/1977 Swartz ..... 40/431
4,156,975 A * 6/1979 Harding ..... 40/427
5,416,674 A * 5/1995 Murai ..... 362/84
5,455,755 A * 10/1995 Bandy ..... 362/284
5,685,097 A * 11/1997 Marinov ..... 40/431
6,249,997 B1 * 6/2001 Lunde ..... 40/431

* cited by examiner

*Primary Examiner*—Thomas M. Sember
(74) *Attorney, Agent, or Firm*—Howard C. Miskin, Esq.; Gloria Tsui-Yip, Esq.

(57) ABSTRACT

A black light display device is provided which utilizes a black light source in combination with fluorescent/phosphorescent display elements which can be thread, strings, monofilaments, disks or sculptured material. The display elements are formed about a spindle which is secure by fixed in a housing which houses the black light source and the fluorescent/phosphorescent elements. One form of housing comprises selectively removable transparent barrier which is transparent to the visible light radiating from the fluorescent display elements but opaque to the ultraviolet light radiating from the black light illumination source.

46 Claims, 25 Drawing Sheets

BLACK LIGHT DISPLAY DEVICE

FIELD OF THE INVENTION

The present invention is directed generally to a kinetic or static device and, in particular, a device for black light display that combines a black light source with fluorescent and craft-oriented, thread structure display elements or disks. Ultraviolet light from the black light source shines on the fluorescent and/or phosphorescent elements to cause them to glow. In one form, the black light source and display element are covered by means of a transparent plastic to prevent the environment where the black light device is displayed from being flooded with ultraviolet light and possibly causing damage to neighboring objects.

BACKGROUND OF THE INVENTION

Ultraviolet lights encompass lights having wavelengths of 4 to 400 nanometers. The longer wavelengths of the ultraviolet light spectrum are called black light, which have wavelengths slightly shorter than those that are normally visible and is generally safe for human viewing. Black light appears as a "deep blue" light because only a portion of the light has long enough wavelengths to be visible to human. For the purpose of this invention, blue black lights are simply called black light. An example of a shorter wavelength in the ultraviolet light spectrum is germicidal ultraviolet light that emits a much shorter wavelength that is dangerous to human skin and eyes.

The barely visible and invisible black light energizes fluorescent and/or phosphorescent pigments of an object which then re-emits the light in visible colors. This results in the object appearing to have an independent glow as if internally lit. Black lights have been used as a source of illumination in theatrical productions, amusement park rides and home use for illuminating art covered with fluorescent and/or phosphorescent paint, and for general atmospheric effects for numerous years. For example, Mr. Toad's Ride, any big party in the late 1960's and the currant rave craze.

A transparent plastic barrier can be used to block or limit the extent of the ultraviolet light shining on fluorescent and/or phosphorescent structures without flooding the entire environment with ultraviolet light. While black lights are deemed safe for humans to use to illuminate objects, long-term exposure of black light can cause fading of fluorescent structures near the black light or other objects in surrounding areas, such as standard water color art pieces or furniture fabrics. Also, while black light has been illuminating all sorts of fluorescent objects, black light as a display in a single unit has not been used. Black light has had a purely utilitarian function from its beginnings for lighting up certain areas to display objects isolated and distinct from the black light source itself.

Therefore, it is a general object of this invention to provide a black light display device.

It is a further object of this invention to provide a black light display device which comprises a black light source for illuminating fluorescent and/or phosphorescent elements.

It is also an object of this invention to provide a black light display device which incorporates a black light source with fluorescent and/or phosphorescent elements in a single unit.

It is another object of this invention to provide a black light display unit that illuminates a string assembly that is selectively rotatably in opposite directions to provide a unique design.

The foregoing and other objects of this invention will become more apparent from the ensuing detailed description of the different embodiments of the invention and the accompanying drawings.

SUMMARY OF THE INVENTION

The invention provides a black light display incorporating a black light source and display elements in a single unit. The display elements may be static or kinetic by mounting the display elements on spindles.

The black light display device of the present invention utilizes a black light lamp having one or more black light sources in combination with fluorescent and/or phosphorescent display elements of different unique objects or artworks. The display elements are craft-oriented and comprise fluorescent and/or phosphorescent string, thread, monofilament, writing, images, or sculpture of fluorescent and/or phosphorescent materials held in position by means of support frames. The support frames provide for easy stringing of different colored string, thread or monofilament for an unlimited number of designs and displays and maybe selectively rotated in opposite directions periodically.

An alternate embodiment of the black light display device of the present invention comprises a selectively removable transparent barrier for the device for containment of the illuminating ultraviolet light. The barrier is transparent to the visible light radiating from the black light source, but opaque to the ultraviolet light to create a hot zone that encompasses the black light source and the fluorescent and/or phosphorescent display elements. The barrier prevents ultraviolet light from escaping the hot zone to radiate out into the surrounding environment by absorbing the ultraviolet light. The display elements located within the hot zone are saturated with ultraviolet light and re-radiate or glow in various visible light colors, which can pass through the barrier. The containment of ultraviolet light with the transparent barrier advantageously allows display of the black light display device among other art works without fear of damaging them.

BRIEF DESCRIPTION OF THE DRAWINGS

In the drawings, wherein like reference numerals are employed to designate like parts or elements.

Figure 1:
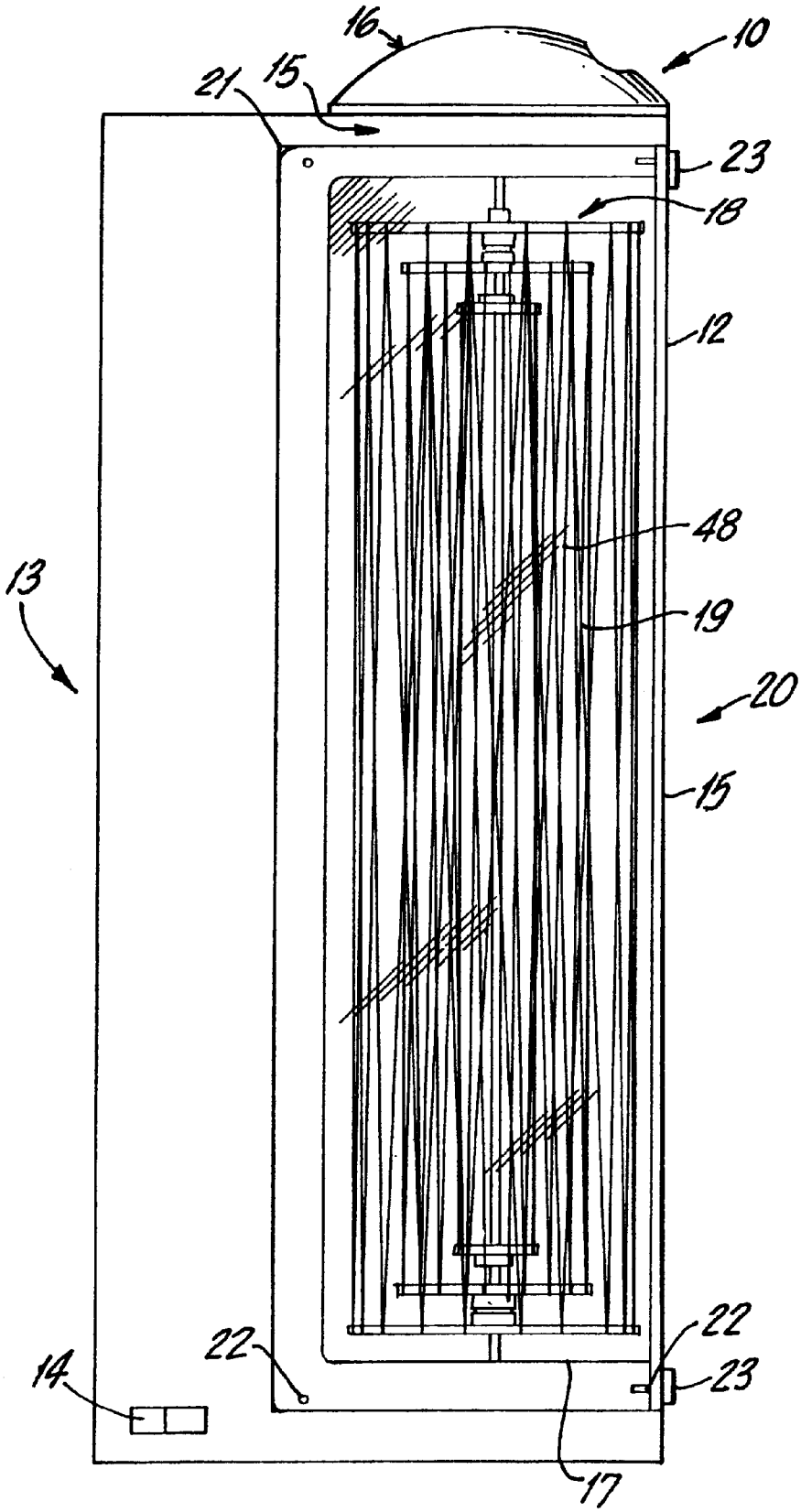
FIG. 1 is a side elevational view of a black light display with display elements supported by a vertical frame in accordance with one embodiment of this invention.
Figure 2:
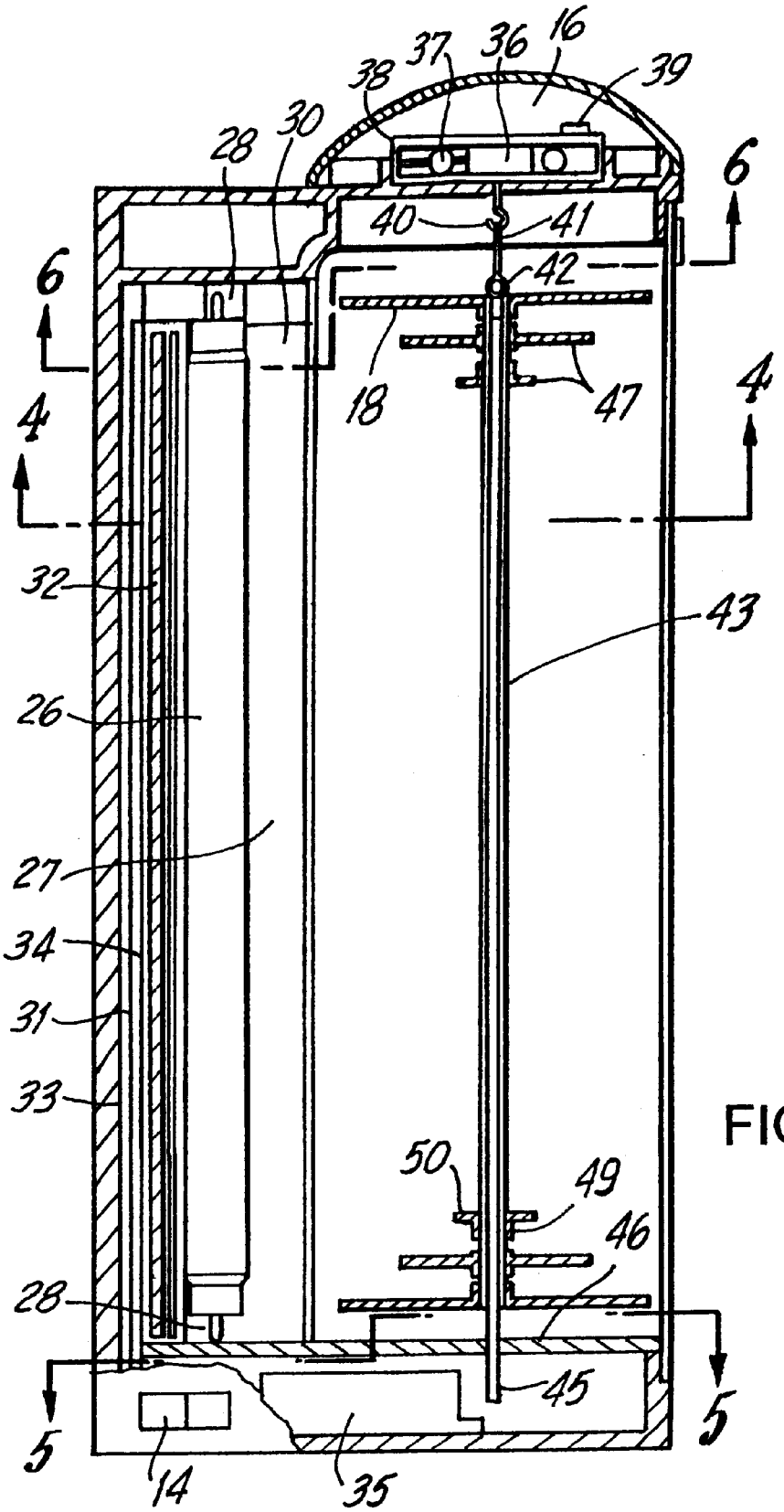
FIG. 2 is a longitudinal cross-sectional view of a black light display having kinetic display elements supported by a vertical frame in accordance with the embodiment shown in FIG. 1.
Figure 3:
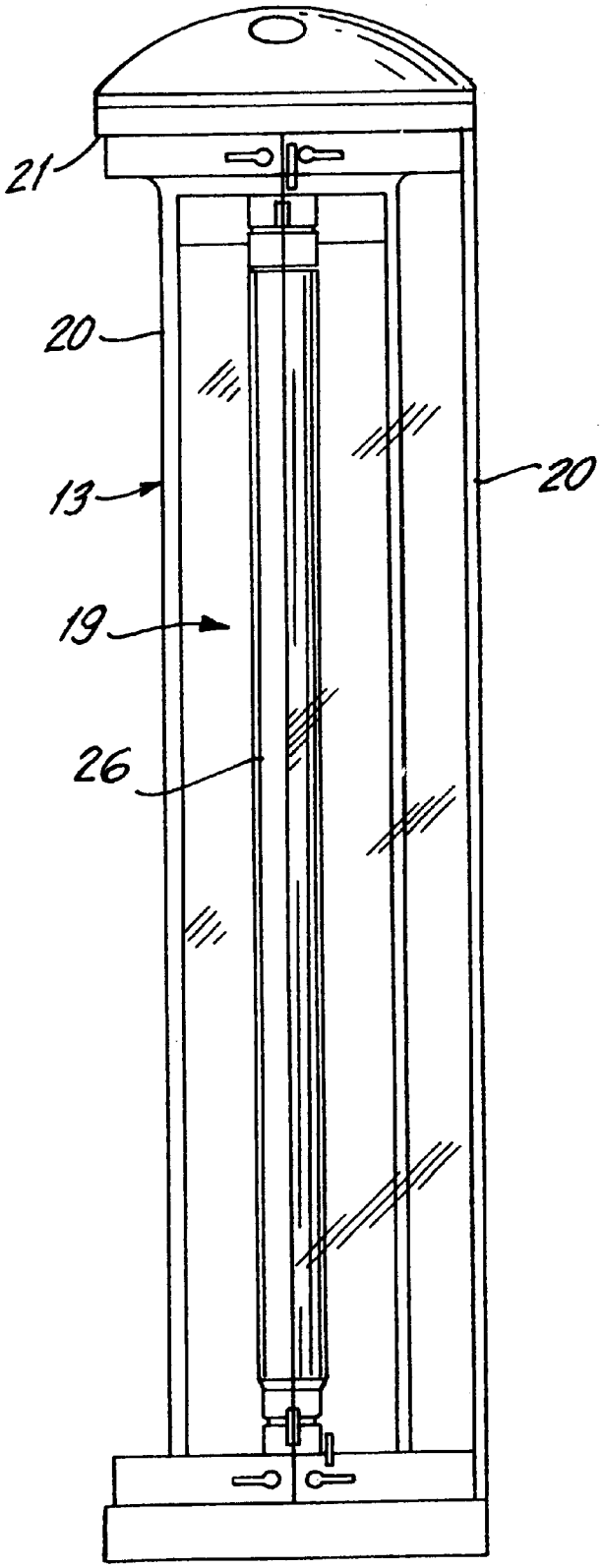
FIG. 3 is a front elevational view of the display device of FIG. 1 with the thread frame display elements removed, illustrating the black light source.
Figure 4:
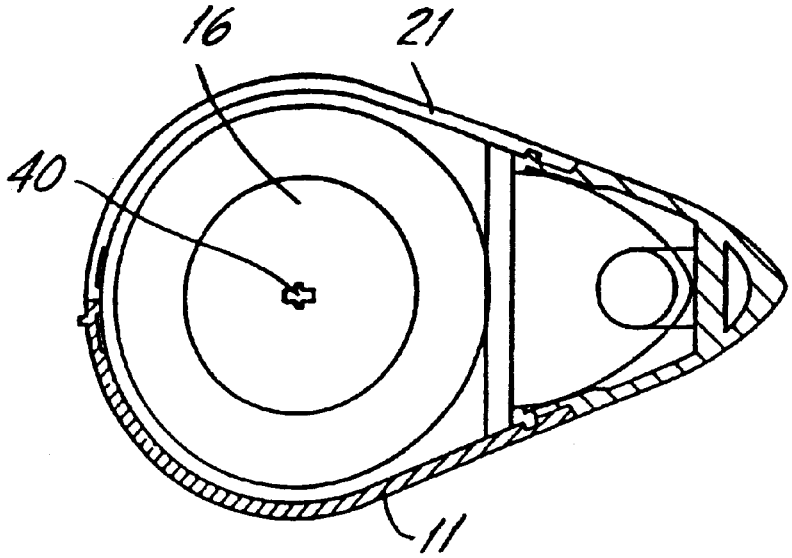
FIG. 4 is a sectional view taken along line 4—4 of FIG. 2.
Figure 5:
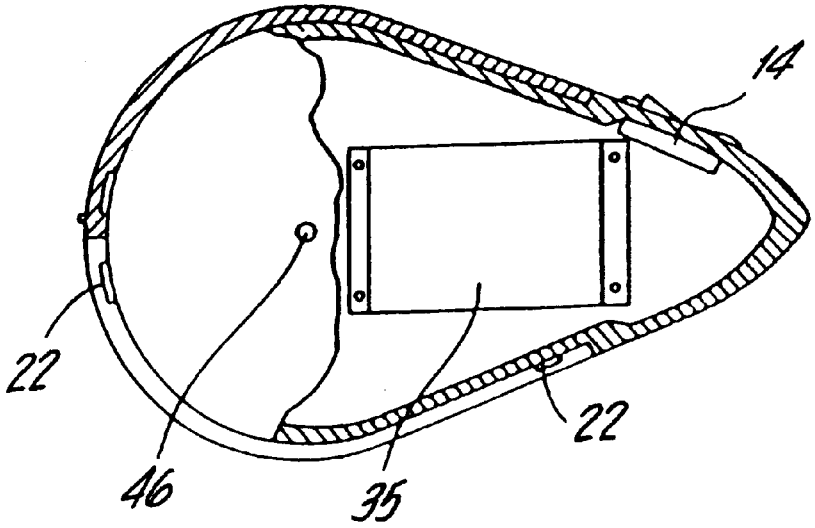
FIG. 5 is a sectional view taken along line 5—5 of FIG. 2.
Figure 6:
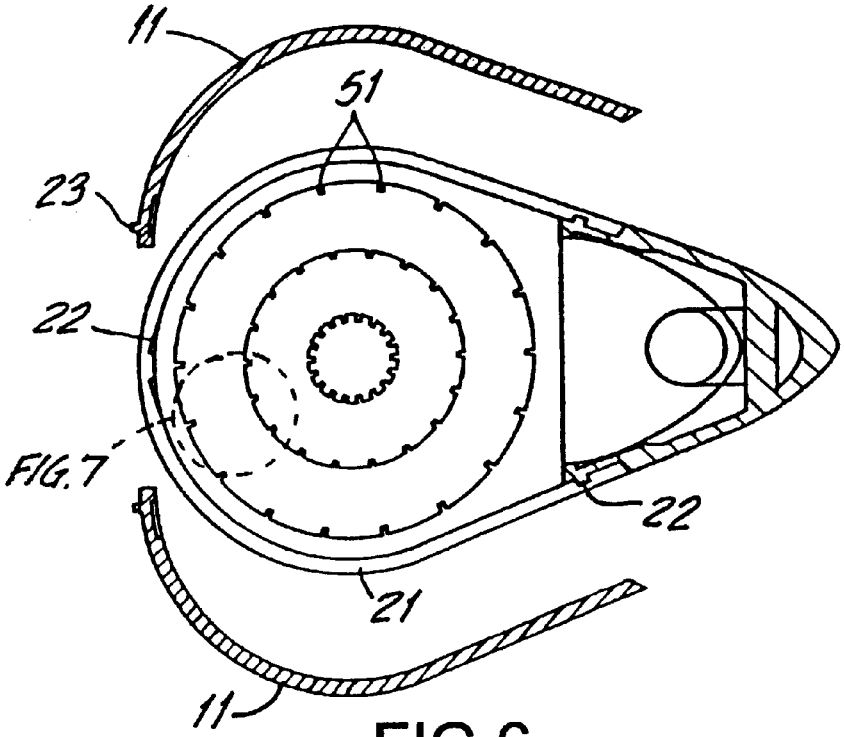
FIG. 6 is a cross-sectional view taken along line 6—6 of FIG. 2.

It must be understood that the foregoing drawings are not drawn to scale and serve merely for purpose of illustration.

DETAILED DESCRIPTION OF THE DIFFERENT EMBODIMENTS OF THE INVENTION

Referring to the drawings, one embodiment is shown in FIGS. 1–7, a black light display lamp 10 comprising a fluorescent or phosphorescent display area 12, a black light housing and vertical lamp support 13, on-and-off switch 14 (see FIG. 5), spindle support 15, a motor housing 16 and the lamp base 17. Mounted within the display area 12 is a spindle assembly 18 having a spindle rotatable about the vertical axis. The spindle assembly is mounted in the display housing 19 surrounded by transparent window 20 which comprises two removable transparent plastic window panels 11 (see FIGS. 4 and 6), made of a suitable clear plastic which permits passage of all wavelengths of visible and ultraviolet (uv) light therethrough. Alternatively, the window panels may be made of a plastic which absorbs uv light while being transparent to visible light. An example of a suitable plastic is UV absorbing Plexiglas® or a simple yellow tinted plastic. One of the two window panels may be made of an opaque plastic which can serve as a back drop for the display area so that the display area is visible only from one side. If both window panels are made of transparent acrylic plastic, then the display area will be invisible from three sides and the ultraviolet light will escape in all directions. If, however, the window panels 11 are made of an ultraviolet-absorbent plastic, then the fluorescent elements will emit the visible light through the window panels, but the ultraviolet light will not.

The display window panels 11 are adapted to fit into the sill 21 by press fitting or any other suitable manner, with each panel being secured to the lamp by the pegs 22. The top and bottom tabs 23 facilitate removal of the window panels. The window panels serve to protect the spindle from prying hands and keeps the display area dust free. When the panels are made from uv absorbing material, they serve to prevent the uv light from escaping from the imaging area while permitting the fluorescent/phosphorescent elements within the display area to shine in the visible light.

The source of uv light is a standard 18" black light (F15 W T8) 26 mounted vertically in the black light housing 27 by means of standard top and bottom fluorescent lamp sockets 28. A lamp reflector 30 comprised of either thin polished metal sheet, or a metallized plastic sheet directs all of the light from the lamp into the display area. A wiring channel 31 between the outer body and the inner vertical support member 32 allows for the two wires 33,34 from the top lamp socket to join the wires from the bottom socket in forming the necessary circuit with the starter switch 14 and the lamp ballast 35. The back body element and the internal vertical support structure serve to strengthen the lamp and reduce torsional flexibility of the entire piece.

Within the motor housing 16 is mounted the motor unit which for convenience sake is an off the shelf item comprised of DC motor 36, batteries 37, a motor controller 38, an on-and-off switch 39, and a mounting hook 40. The motor controller turns the motor on for a short interval (2 seconds) causing it to spin in one direction, then it is turned off for a long duration (in this case 24 seconds), then it is turned on in the opposite direction for the same short interval, with again an intervening off period of 24 seconds and so forth.

The spindle assembly is suspended from the motor hook by means of a spindle loop 41 which is made of a tough woven string, or single monofilament. This loop is held by a second hook, the spindle hook 42 which is press fit to the spindle shaft 43. The shaft 43 is a transparent plastic tube running the entire length of the spindle assembly, and is stabilized by means of the bottom spindle axle 45 which is spinnably mounted in the spindle shaft hole 46. Press fit over the spindle shaft are numerous radially symmetrical string frame disks 47 of different diameters. These disks may be either made of clear plastic or opaque plastic. The spindle assembly supports the decorative fluorescent elements of the lamp, fluorescent 48 threads of differing colors (see FIGS. 8 and 9). The frame disks [may be made of clear or opaque plastic, and] can contain fluorescent pigment so that they can fluoresce and be an active part of the design. This configuration of the spindle is best used for spinning in one direction continuously.

Figure 8:
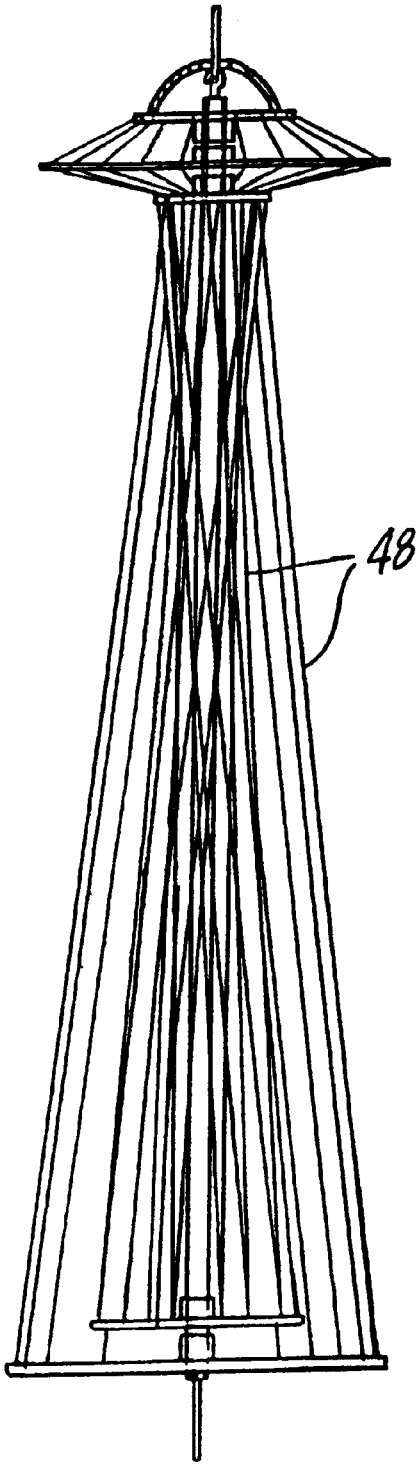
FIG. 8 is a front elevational view of a thread frame display element used in one embodiment of this invention.
Figure 9:
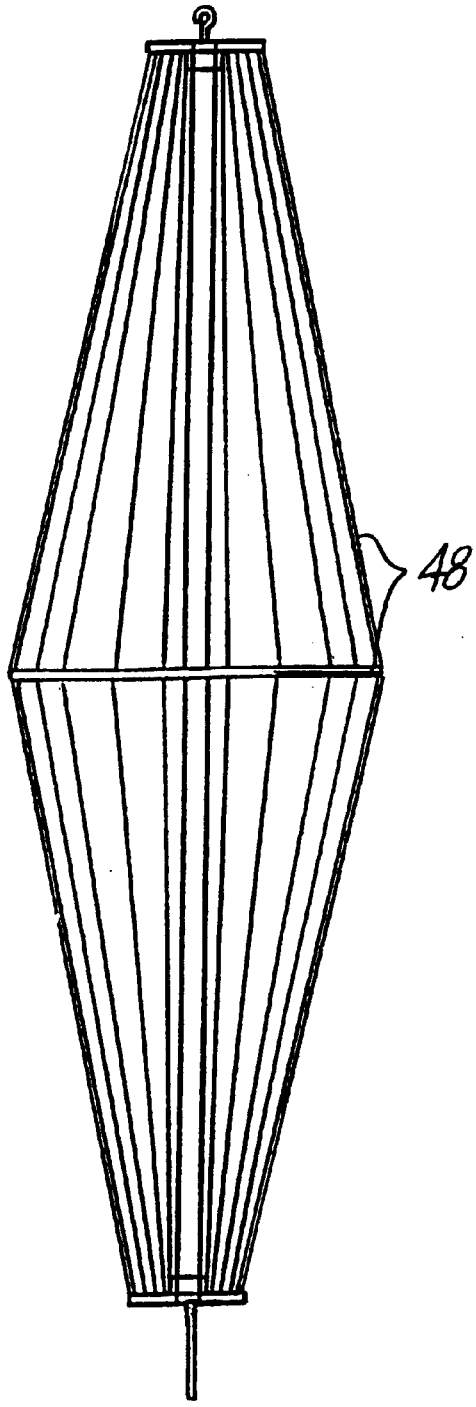
FIG. 9 is a front elevational view of another thread frame display element.

The spindle assembly may be formed in several configurations (see FIGS. 8 and 9). Each string frame disk is comprised of a disk flange 49 (see FIG. 2) and disk 50. The flange gives the disk perpendicular stability with respect to the spindle shaft. Evenly and radially arrayed about the edge of each disk are thread notches 51 (see FIG. 6). Some larger disks may sport even multiples of the number that are contained on the smaller disks. With the stringing frame disks in place the entire spindle assembly becomes a rigid string frame. With a spool of one color of fluorescent thread, red for instance, the craftsman or hobbyist hooks the thread into a bottom notch up to an upper disk and notch and back down and so forth until completely circling the spindle and returning to the upper point or origin. Thus by a zigzag stringing of the frame a certain design is formed. With a different color thread another pattern is strung.

Figure 7:
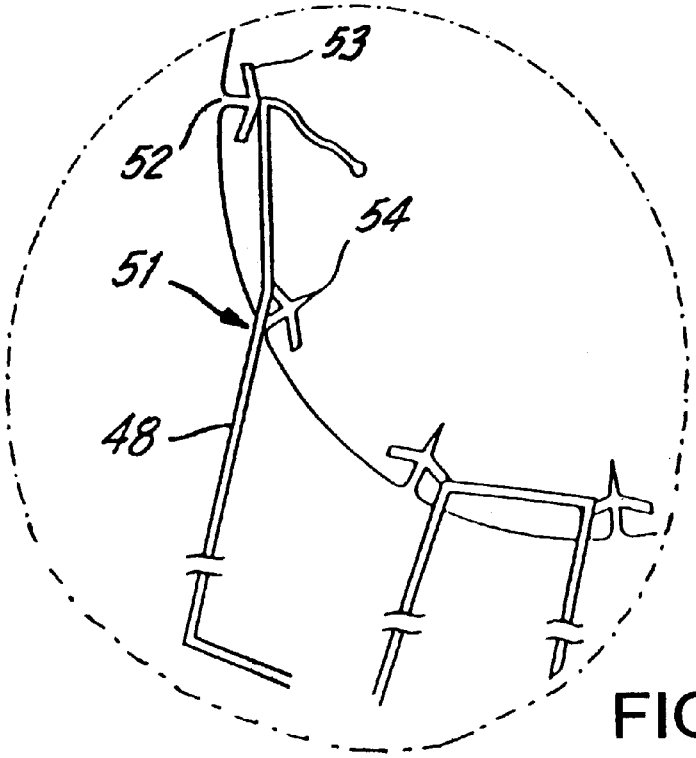
FIG. 7 is an enlarged detailed view of a section of FIG. 6.

In order for the process of stringing to be as simple as possible, the notch design on the disks is important. FIG. 7 illustrates one such design, It is of course important that it be a notch and not a hole. If it were a hole then the pattern would have to be threaded through an endless number of holes and the entire string pulled through until a complete pattern was achieved. It is easier to be able to loop the thread into a notch thus avoiding the endless threading process.

The notch shown in FIG. 7 has features that allow the thread to be directed away from the notch in almost any direction without coming loose from the notch. The notch is comprised of an entrance port 52, two side slots 53 and thread catching wedge 54. To start a pattern, the thread is wedged into the thread catching wedge and the stringing process is started. The thread hooks into either one of the two side slots allowing the thread to head off in any direction without coming out of the entrance hole. Upon coming full circle in the stringing process the thread is then finished off by again being wedged in the thread catching wedged slot. In the entire process the thread is kept just slightly taute. Too much tension can warp the entire spindle. The stringing process is aided by having the spindle assembly hook to the motor hook, but with the motor off. The spindle then is easily rotated for easy access during the stringing process.

Figure 10:
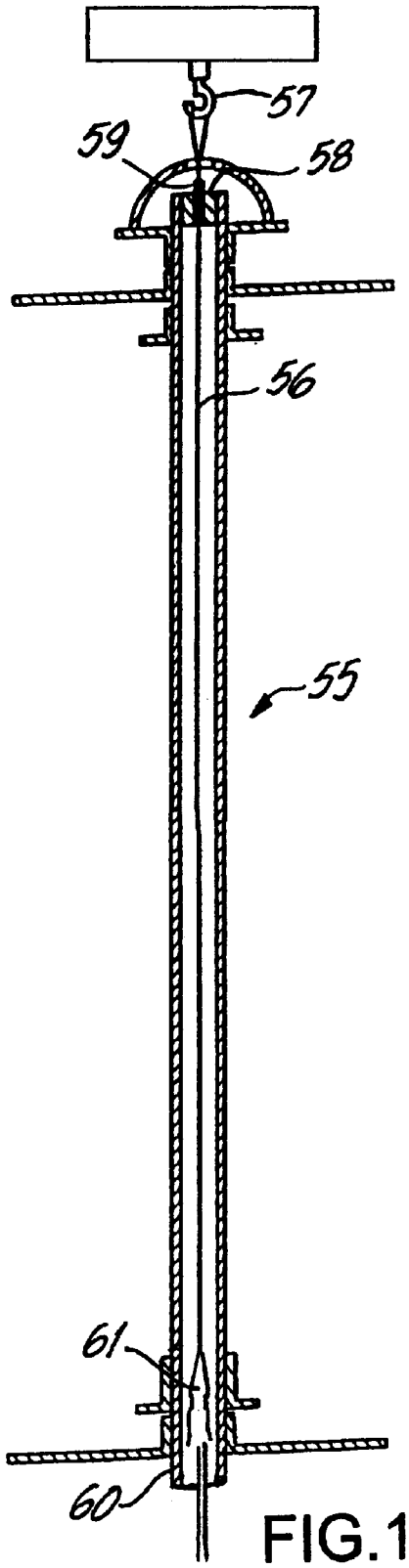
FIG. 10 is a front elevational view of a kinetic display element for constant rotational reversal in accordance with one embodiment of this invention.

FIG. 10 illustrates a thread-framing spindle 55 suitable for being spun in alternating directions, first clockwise then counterclockwise and so on, indefinitely. A monofilament line 56 is looped about the motor hook 57 and passes through a central shaft hole 58 of the upper spindle shaft fitting 59. This should be made of a low abrasion material such as ultra high molecular weight polypropylene. The monofilament line passes all the way down to the bottom of the spindle shaft and attaches to a bottom shaft fitting 60 through eye loop 61. The monofilament is free to spin within the central shaft hole of the upper fitting while supporting the whole spindle assembly from the bottom. This allows the monofilament to be twisted for a considerable length when the motor spins up and thus avoids undue stress on the filament if the motor is set for alternating direction of rotation.

In operation, and referring to the display device shown in FIGS. 1–7, when the motor spins briefly, it twists the monofilament line, thus causing the spindle to spin in the same direction as the line untwists. The spindle continues to spin by momentum and twists the line up in the opposite direction at about which time the motor reverses and spins in the opposite direction causing the spindle to spin in the reverse direction from its original spin. This cycle can be repeated endlessly. The result is that the spindle spins rapidly, slowing to halt, and then spinning in the opposite direction rapidly and so on. At the higher spinning rates of this cycle a new and surprising result ensues because the black light is in actuality strobing at 60 cycles per second. The rapidly spinning threads thus produce multiple images reducing their materiality and making them appear to be constructed of packets of light energy.

Figure 11:
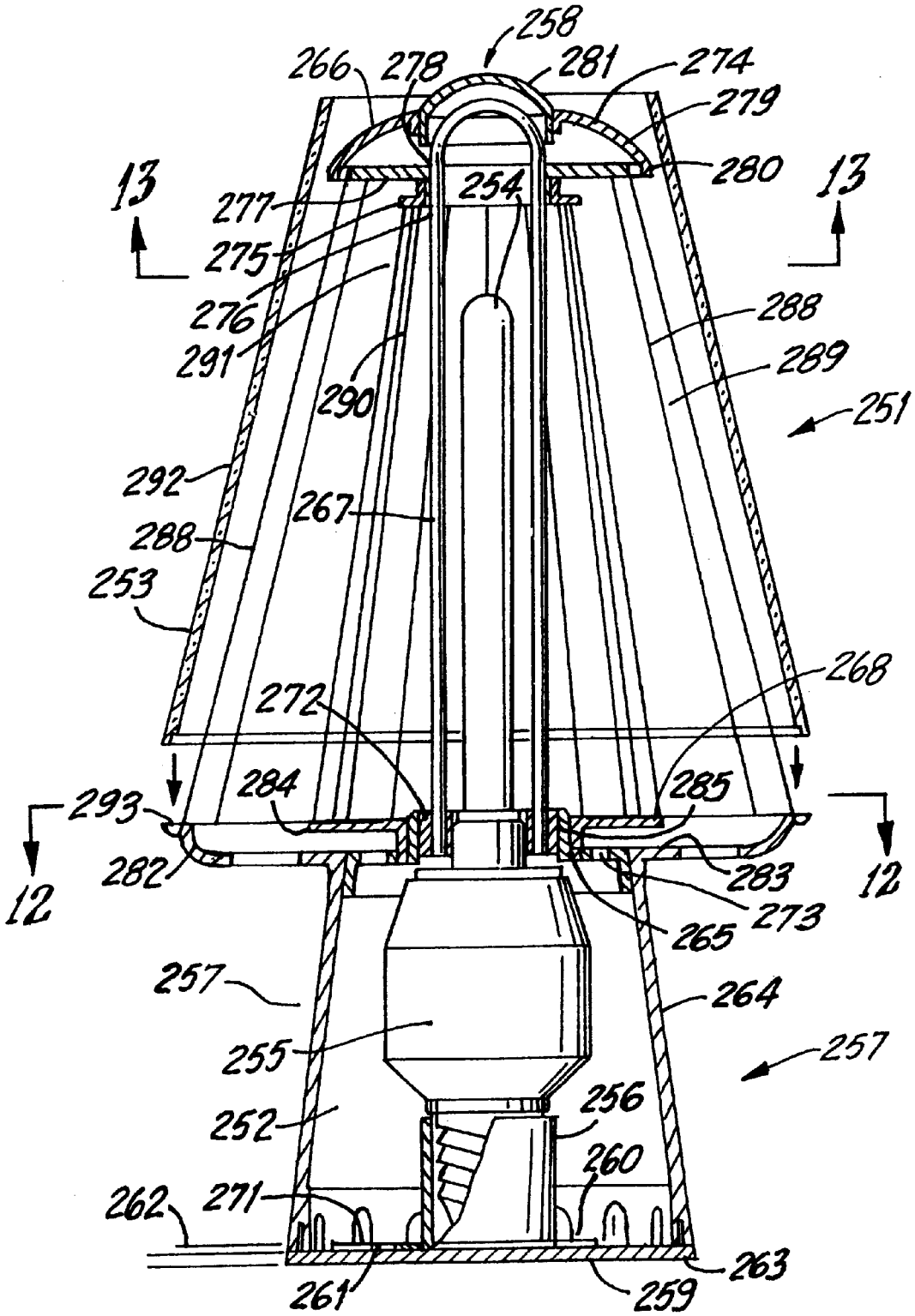
FIG. 11 is a longitudinal sectional view of a uv lantern according to another embodiment of this invention.
Figure 12:
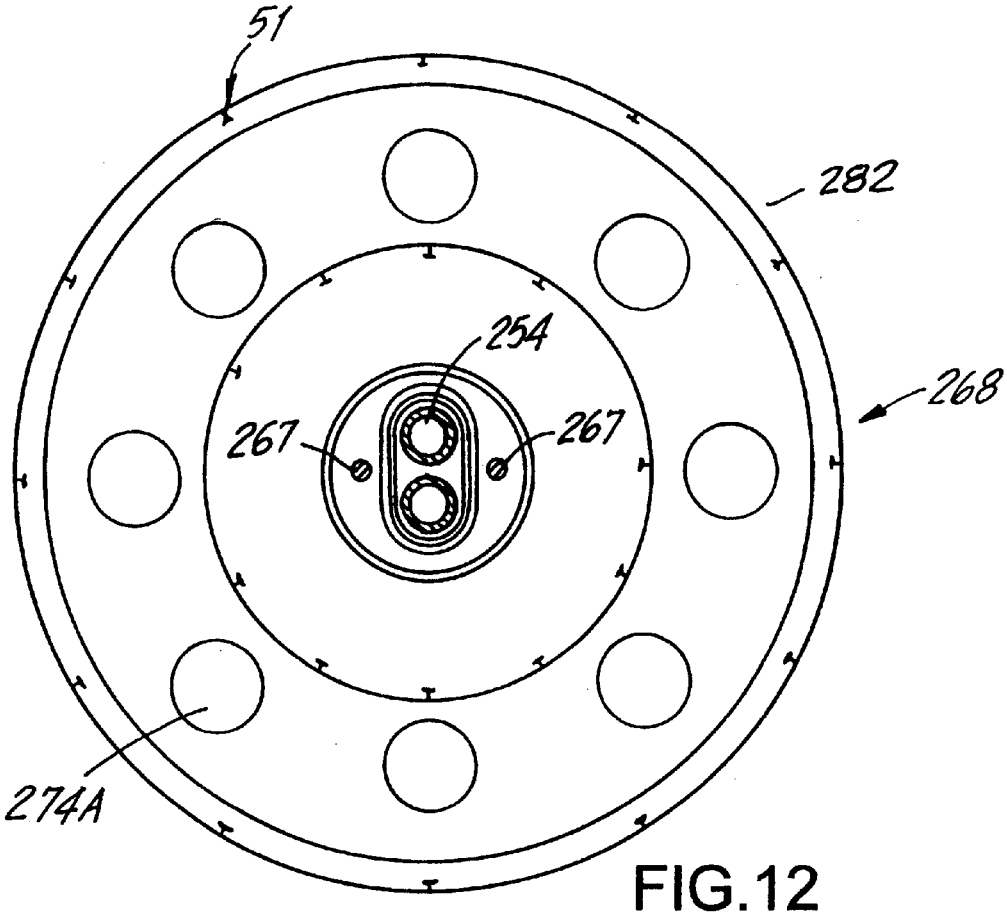
FIG. 12 is a cross-sectional view taken along the line 12—12 of FIG. 11.
Figure 13:
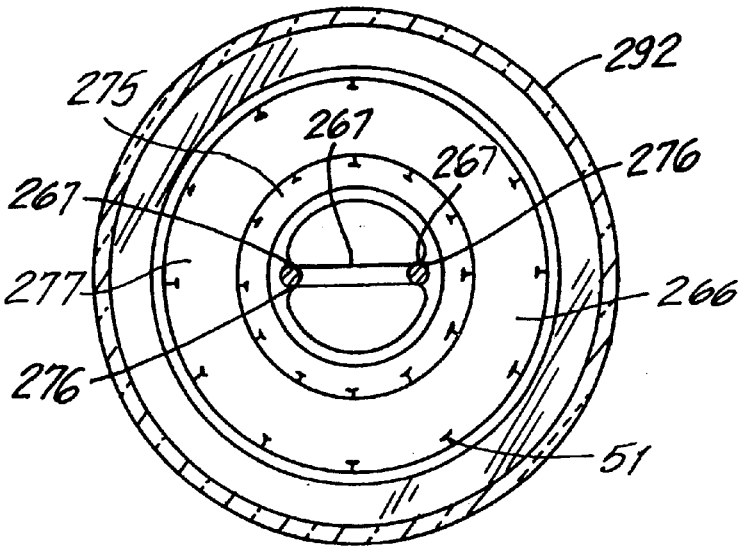
FIG. 13 is a cross-sectional view taken along line 13—13 of FIG. 11.

In the second embodiment of the invention, there is shown in FIGS. 11–13, a black light lamp 251 resembling a lantern and comprising a screw in type biaxial uv lamp 252 mounted vertically in the central axis of a radially symmetrical lantern 253. The uv lamp further comprises a 9 watt biax uv lamp bulb 254 mated to a ballasted standard size screw type adapter 255 which is screwed into a standard 110 volt bulb socket 256 mounted to the lantern.

The lantern further comprises a base 257 and a stringable lamp shade assembly 258. The base 257 comprises a round base plate 259 with the socket screw 260 to hold the uv lamp vertically and centrally, a tie down 261 to position and hold down the 110 power cord 262, and three or more lamp base screws 263 to affix the base to the conic shade base 264 of the stringable lamp shade assembly. To change the bulb, the entire stringable lampshade assembly is lifted off of the lamp base. The conical shape of the bottom section of the stringable lamp shade assembly prevents the use of incandescent black lights which have a larger height dimension than the top 265 of the conic shade base will allow.

The stringable lamp shade assembly is comprised of an upper string frame subassembly 266, supported by a metal support loop 267, lower string frame subassembly 268 and the conic shade base. All the elements of the lower string frame subassembly are designed to be hard press fitted by means of tapered joints. They are all made of plastic, either opaque or transparent. Some of these elements can be permanently fitted by means of glue in the taper fit joint. The metal support loop is made of a ⅛" diameter metal rod bent into a U shape with both ends hard press fit into the support base 272. The support base is taper fitted to the conic shade base flange 272. The lamp is not very hot, being at most a 9-watt fluorescent type bulb and ballast. Nevertheless, convective air cooling is supplied by means of numerous radially arranged lower air hole arches 271 that allow egress of ambient cool air which is heated by the bulb and rises through numerous radially arranged upper conic shade base holes 273.

The upper string subassembly is comprised of an upper, inner string frame disk 275 made of transparent fluorescent plastic press fit to the outer string frame disk 277 also made of a transparent fluorescent plastic taper press fit to the upper flange 278 of the inner string frame disk. The outer string frame disk is mounted to the metal support loop by means of two clip protrusions 276 (see FIG. 13). A decorative over cap 279 fits over the outer string frame ring and is placed thereafter the lamp has been strung. It is comprised of an opaque dish 280 with air holes 274 and a central dome 281 taper press fit to it and made of transparent fluorescent plastic. This cap contributes to giving the upper string subassembly the appearance of a flying saucer. The air holes allow heat to escape if the UV containment shade 292 is in place. Additional ventilation is affected by means of air holes 274A in the lower string frame disk 282. When the UV lamp is on, the light causes the dome and underside of the "saucer" (i.e. the upper and lower string frame rings) to glow.

The lower string subassembly is comprised of a lower, outer string frame disk 282 taper press fit 283 to the conic shade base and a lower, inner string frame disk 284 taper press fit 285 to the conic shade base. Both of these rings may be either transparent plastic or opaque plastic.

FIGS. 12 and 13 are cross-sectional views of the lamp of FIG. 11. Each string frame disk is shown with the same type of thread notches (51) of the lamp of FIG. 1, details of which are revealed in FIGS. 6 and 7.

The lamp of FIG. 11, is shown strung with fluorescent thread (288, 290) in a simple tapered vertical fashion in which a single thread 288 is strung between the upper and lower outer string frames forming an outer "cage" 289 and a second thread 290 is strung between the inner, upper string frame, and the lower, inner string frame forming a second inner "cage" 291.

As in the lamp in FIG. 1, the lamp of FIG. 11 is provided with an optional uv containment shade 292 shown here partially raised and indicating that it can be lowered to fit the rime 293 of the lower, outer string frame disk. As in the lamp of FIG. 1, this conic uv blocking cover surrounds the fluorescent decorative elements of the lamp allowing the visible light to escape while containing the uv light from the uv bulb itself. It can be made of the same uv absorbing Plexiglas® material or yellow tinted transparent plastic of the uv guard of the lamp of FIG. 1.

Figure 14:
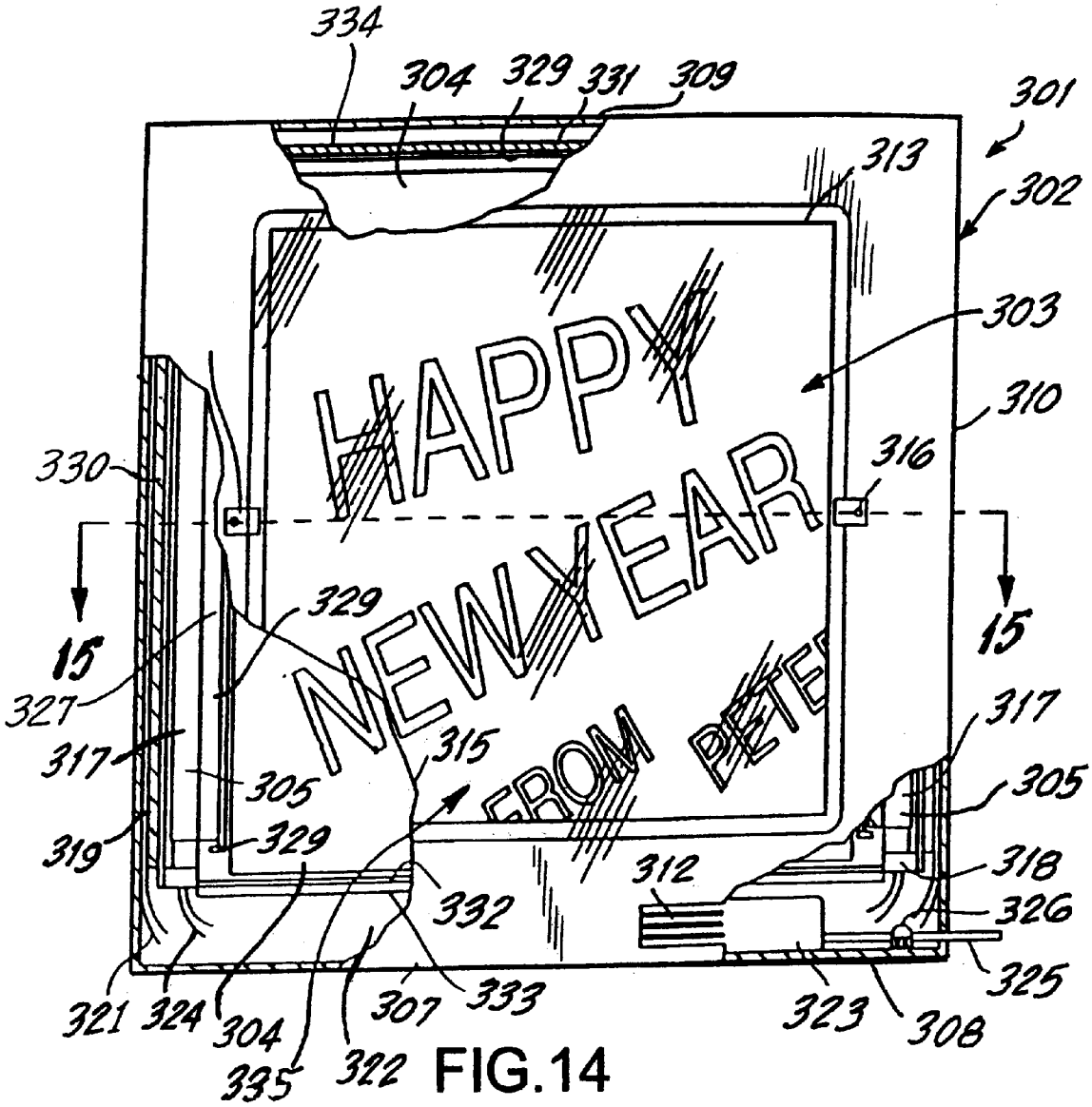
FIG. 14 is a front elevational view with partial cutaway of a uv illuminated display case with an erasable sign board in accordance with another embodiment of this invention.
Figure 15:
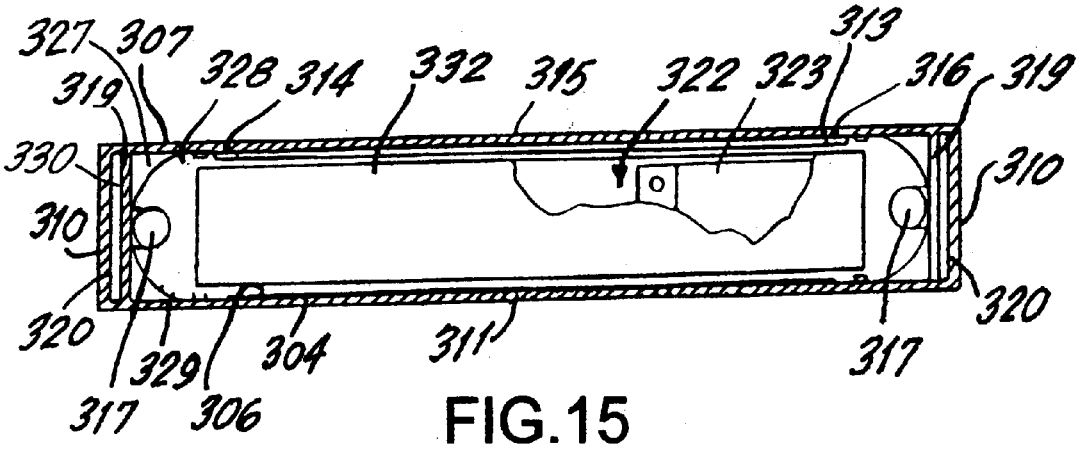
FIG. 15 is a cross-sectional view taken along line 15—15 of FIG. is 14.

In a third embodiment of the invention illustrated in FIGS. 14 and 15, there is shown a uv lamp in the form of an illuminated display case containing an erasable sign board. This lamp is described in order to illustrate the broad application of the invention in one of its aspects. That aspect is the use of an optional and/or removable transparent window made of a uv absorbing plastic that is transparent to visible light which, when in place, prevents uv light from escaping to the surroundings while allowing any visible light from objects or images made of fluorescent materials that are within the display volume to escape and be visible. The most common form of this material is uv absorbing Plexiglas®. A simple material is yellow tinted clear plastic. An alternative material uses a different approach by selectively reflecting uv and passing on visible light. This is common in uv safe sunglasses and uv safe window panes in which a reflective layer is added that selectively reflects uv while passing on visible light.

Referring to FIG. 14, a uv illuminated display case 301 is comprised of a box like housing 302, a viewing port 303, an erasable sign board 304, and two uv illumination sources 305. The erasable sign board is optimally dark black instead of the white which is commonly seen. It is overcoated with protective plastic coating 306 which allows for the use of off the shelf fluorescent erasable markers, or fluorescent grease pencils for making art designs and/or informational signs. Depicted on the sign board is HAPPY NEW YEAR FROM PETER written by means of erasable fluorescent felt tip pen ink.

The outer body of the housing is opaque and comprised of a front panel 307, a base panel 308, a top panel 309, and a right and left side panel 310, and a back panel 311.

The front panel has ballast vent openings 312 and a viewing port opening. The viewing port is framed by a sill 313 forming a window recess 314 within which the uv absorbing Plexiglas® window pane 315 is removably flush mounted by means of right and left metal rotatable retaining tabs 316. With tabs rotated 90 degrees to their current position the window pane is easily removed allowing for access to the sign board for writing and/or erasing images and replacing worn out uv tubes.

The erasable sign board is glue mounted to the inside surface of the back panel. Two illumination sources (a right and left source) are each comprised of a F15 T8 black light tube 317 vertically aligned and removably mounted to top and bottom standard bulb sockets 318 which are affixed to an inner bulb support member 319. This member is an inner extension of the box housing and forms a wiring channel 320 to allow for the upper two wires 321 that connect the upper socket to the complete circuit to pass down to the ballast area 322 containing the ballast 323 (in this case a Universal Thermo-matic trigger start ballast for two F15 T8 uv bulbs) and the lower two wires 324, the line voltage wires 325 and strain relief fitting 326. The light from the uv tube is directed to the sign board by means of a curved plastic mirror reflector 327 which is loosely retained by means of a front 328 and back 329 mirror retaining wall protrusion and the wall 330 of the inner bulb support member. Further distribution of the uv light is aided by an upper 331 and lower 332 plastic mirror supported by a lower inner support member 333 of the housing, and an upper mirror support member 334 of the housing. The uv light thus emitted by the two tubes is reflected about by means of the surrounding mirrors, and is prevented from leaving by means of the mirrors, the opaque housing, and the uv absorbing front window pane, defining a uv containment volume 335 within which an erasable sign board with fluorescent marking on it, or any other fluorescent and/or phosphorescent three dimensional objects may reside to be excited by the contained uv light to emit light in the visible spectrum, this light being able to pass through the window pane and be seen.

Figure 16:
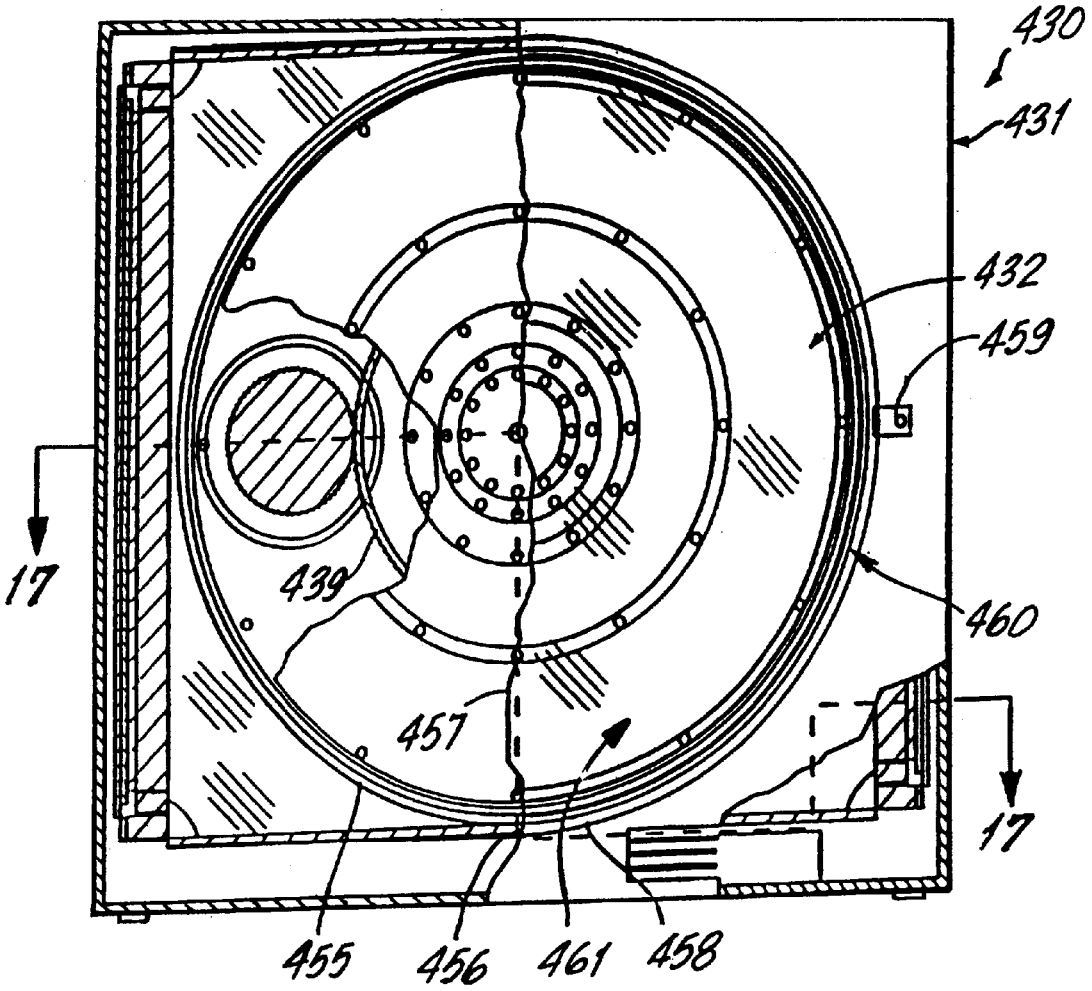
FIG. 16 is a front elevational view with partial cutaway of a uv lamp with a horizontal spindle with the spindle in unstrung position, according to a further embodiment of this invention.
Figure 17:
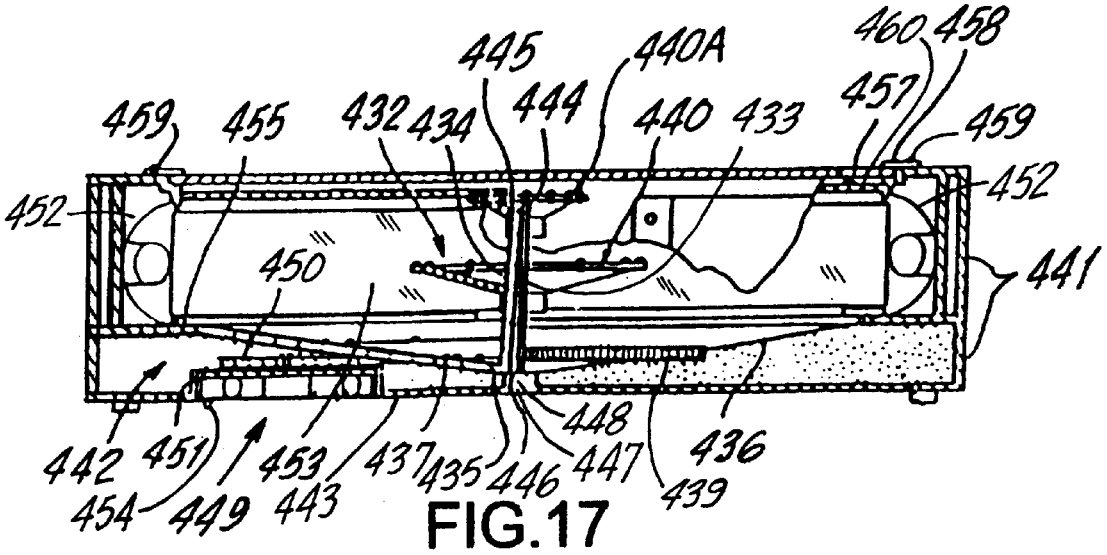
FIG. 17 is a sectional view taken along line 17—17 of FIG. 16.

FIGS. 16 and 17 which show a kinetic uv lamp 430 comprised of a box housing 431 nearly identical to that of the lamp of FIG. 14, but modified to house a horizontally and spinnably mounted spindle 432 to be viewed roughly head on to the axis of rotation. The uv bulbs, their orientation, the ballast, and wiring, and the support structures and plastic mirrors for the lamp are substantially identical to the lamp of FIG. 14.

Figure 19:
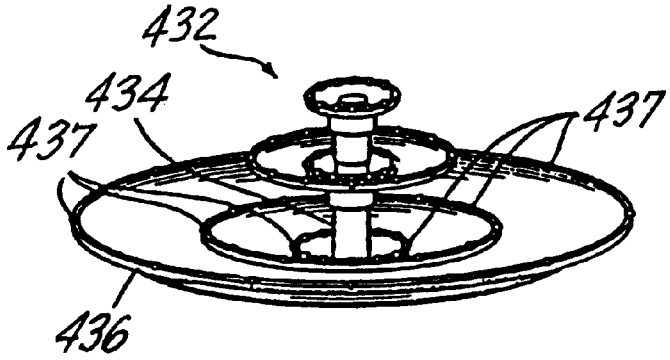
FIG. 19 is a perspective view of the spindle of the lamp shown in FIG. 16.

The spindle (see FIGS. 17 and 19) is comprised of a main spindle member 433 that is opaque and optimally black. This member is moldable as one unit but is further comprised of a tapered axis tube 434 merging at its base 435 into a primary conic display disk 436. This disk is shown perforated with an array of radially symmetrical post holes 437 and pins are depicted in the primary conic display disk. Finally, the back side of the primary conic display disk is molded into a gear ring 439. A middle conic transparent display disk 440 and a top conic transparent display disk 440A are taper press fitted to the outside of the tapered axis tube. They are likewise perforated with a radially symmetric set of holes with threading post pins inserted therein. These two transparent conic disks are removable and replaceable with disks of differing diameters to offer other variations in design as in the lamp of FIG. 1.

The sides 441 of the housing are wider than the sides of the lamp of FIG. 15 allowing for the inclusion of a spindle and motor drive mounting area 442. The spindle is spinnably mounted to the center of the back wall 443 by means of a perpendicular axle pin 444. The pin is threaded through the front shaft hole 445 of the tapered axis tube, and through the back shaft hole of the back press fit shaft bushing 446. The pin is hard press fitted into the back wall shaft hole 447 of the spindle mounting flange 448. The geared motor unit 449 is identical to the unit used in the lamp of FIG. 1 except that instead of a hook, it has a drive gear 450. The motor is taper press fitted into the motor mounting flange 451 in the back of the lamp. The unit is thus accessible from the back for turning the motor on or off by the switch 454 and spins the spindle. As in the lamp of FIG. 1, the spindle may be spun clockwise, then allowed to coast to a stop, and then spun counter clockwise and so forth, or it may be a simpler version with the gear motor simply driving it continually in one direction of rotation.

The primary conic display disk of the spindle is framed by the back frame wall 455 which along the black primary conic display disk of the spindle hides the motor drive mounting area from view and serves to function as the backdrop of the fluorescent elements and define the back of the uv containment area 456 bordered by the two curved side mirrors 452 and top and bottom flat mirrors 453, the uv tubes and the front optional and removable circular transparent uv absorbing Plexiglas® window pane 457.

The front portal of the lamp 457 of FIG. 16 differs from that of the lamp of FIG. 14 in several ways. It is circular instead of square to accommodate the circular shape of the spindle. The round window pane fits within the outer sill 458 and is held by means of two metal clips 459 such that when turned 90 degrees allows for the removal of the window pane. Thus the removed lamp is accessible for stringing, for exchanging the upper transparent conic disks for other disks, and for changing worn out black light tubes. A static decorative thread frame 460 is comprised of an inner static thread frame sill 461 which is radially symmetrically perforated With post holes containing thread post pins 462. The heads 462 of the pins do not protrude above the plane of the window pane thus allowing the pane to be properly flush mounted.

Figure 18:
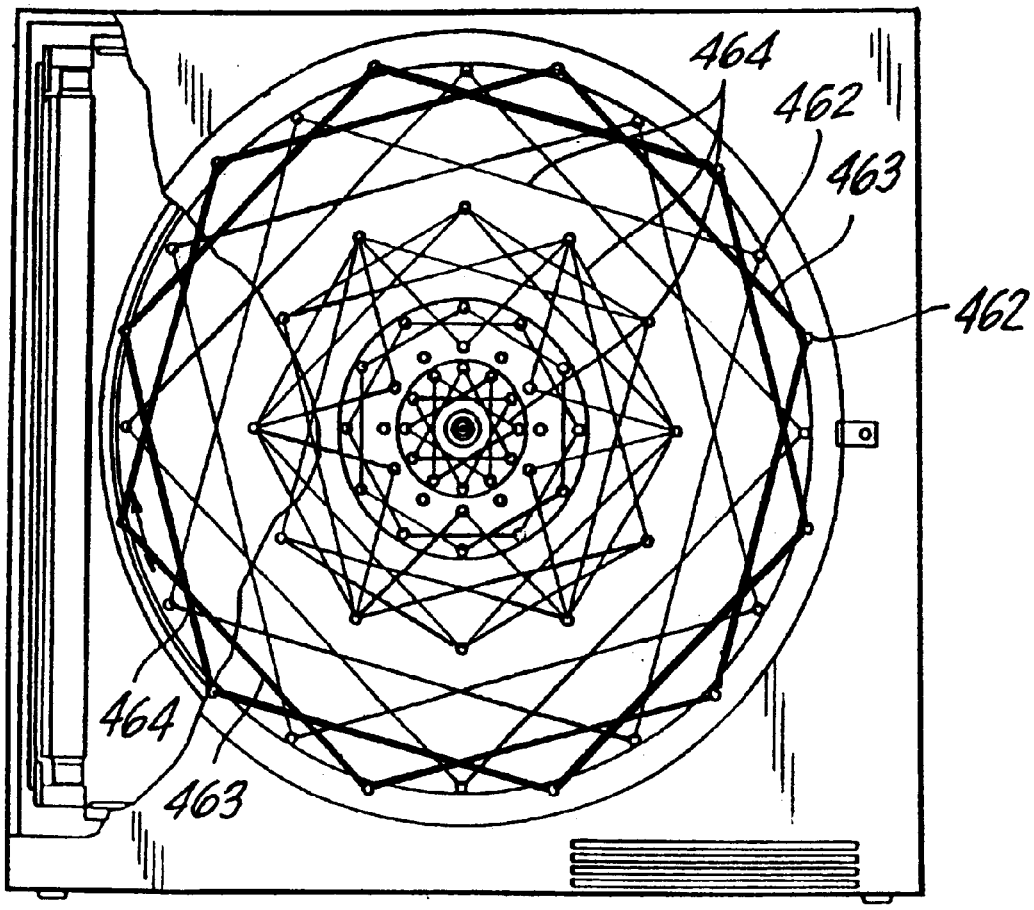
FIG. 18 is a front elevational view with partial cutaway of the device of FIG. 16 with the spindle in strung configuration.

FIG. 18 illustrates the lamp of FIG. 16 fully threaded. It is partially cut away to help contrast the fluorescent threads 463 of the static frame, shown here as being thicker than the spinnable fluorescent threads 464 strung on the spindle. The threads of the spindle will multiply and become less material in appearance due to the same effect described in the lamp of FIG. 1. That is, the uv lamps will strobe at 60 cycles per second causing each moving fluorescent thread to leave multiple images of itself.

Figure 20:
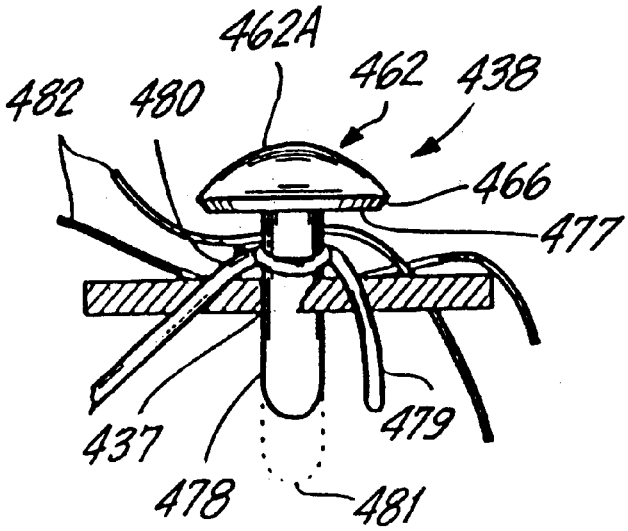
FIG. 20 is a front elevational view of a detail of the lamp of FIG. 16 showing a thread-stringing pin.

Threading is accomplished in much the same way as in the lamp of FIG. 1. However a post pin system is used to anchor the threads instead of the notch system of the lamp of FIG. 1. To begin the process, post pins 462 are inserted into the appropriate post holes 437 for the desired pattern. They are inserted firmly but not all the way down. A typical post pin partially inserted into its post hole firmly but all the way down, as illustrated in FIG. 20. The post pin is comprised of the dome shaped 462A with a beveled edge 466 and flat underside 477 and a tapered shaft 478. The thread is started as in 479 by wrapping around the pin shaft 480 and then pushing the pin all the way down 481 pinching the thread and preventing it from unraveling. The thread is then strung about all the other appropriate partially inserted pins on the spindle, or if the thread is a part of the static frame, then about those pins. If the end of the thread 482 is returned to the beginning pin then it is hooked under the level of the pin head and wrapped about it, thus lifting the head slightly in the process. Pushing the pin back down holds the beginning loop and end loop of the thread in place. When the patterns are completed, all the pins may be pushed all the way down to prevent loosening of the threads. The illustrated threaded pattern is only one of a virtually limitless sets. Other threading patterns are possible, including threadings between the conic disks of the spindle.

Figure 21:
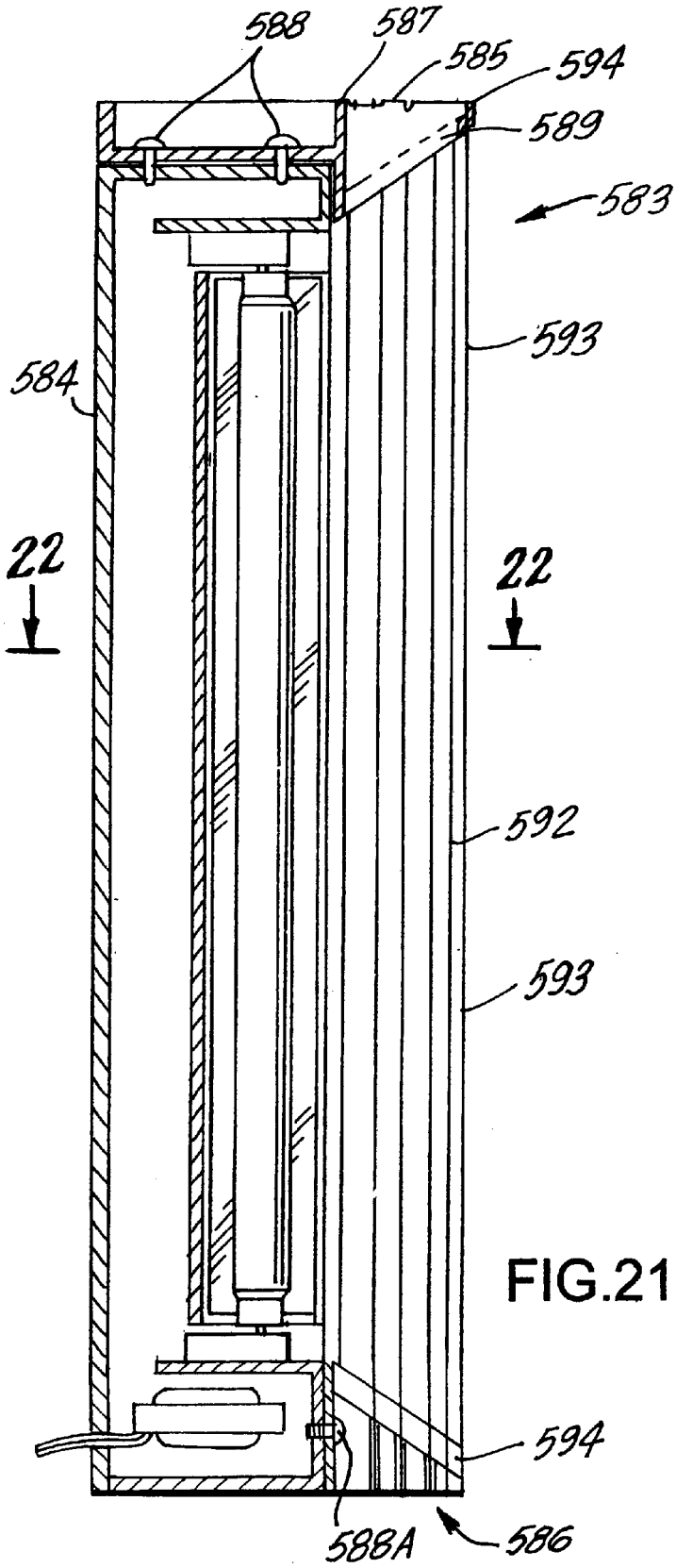
FIG. 21 is an elevational sectional view of a black light display device with attachable static stringing frames in accordance with another embodiment of the present invention.

A fifth embodiment of this invention is illustrated in FIGS. 21–24. FIG. 21 shows a modular black light fixture 583 comprising a simple black light source 584, attached upper stringing frame 585 and a lower stringing frame 586. Both string frames are "D" shaped (see FIG. 22). The upper stringing frame is mounted through extension piece 587 by means of screws 588 to the simple black light fixture. The lower stringing frame is secured to the black light fixture by screws 588A. The two string frames both have an arch member 589 with evenly interspersed notches 590 and groves 591 which allow for the tensioned stringing of fluorescent thread 592 to form a decorative front piece through which the UV is emitted, the threads appearing as extremely bright self-illuminated linear elements. An optional UV absorbing plastic cover 593 fits snugly into the top and bottom sills (594) of the string frame elements.

Figure 22:
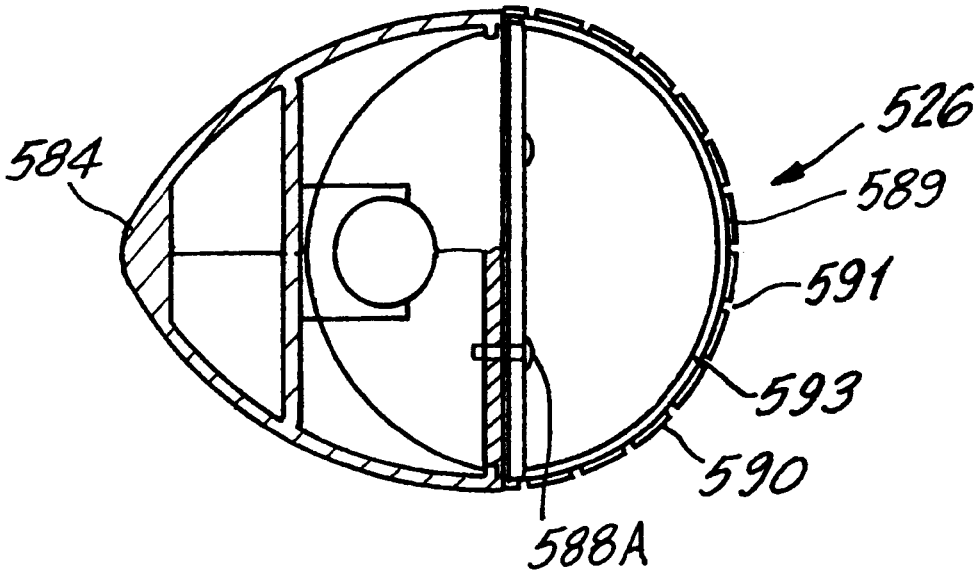
FIG. 22 is a cross-sectional view of the display device shown in FIG. 21.
Figure 23:
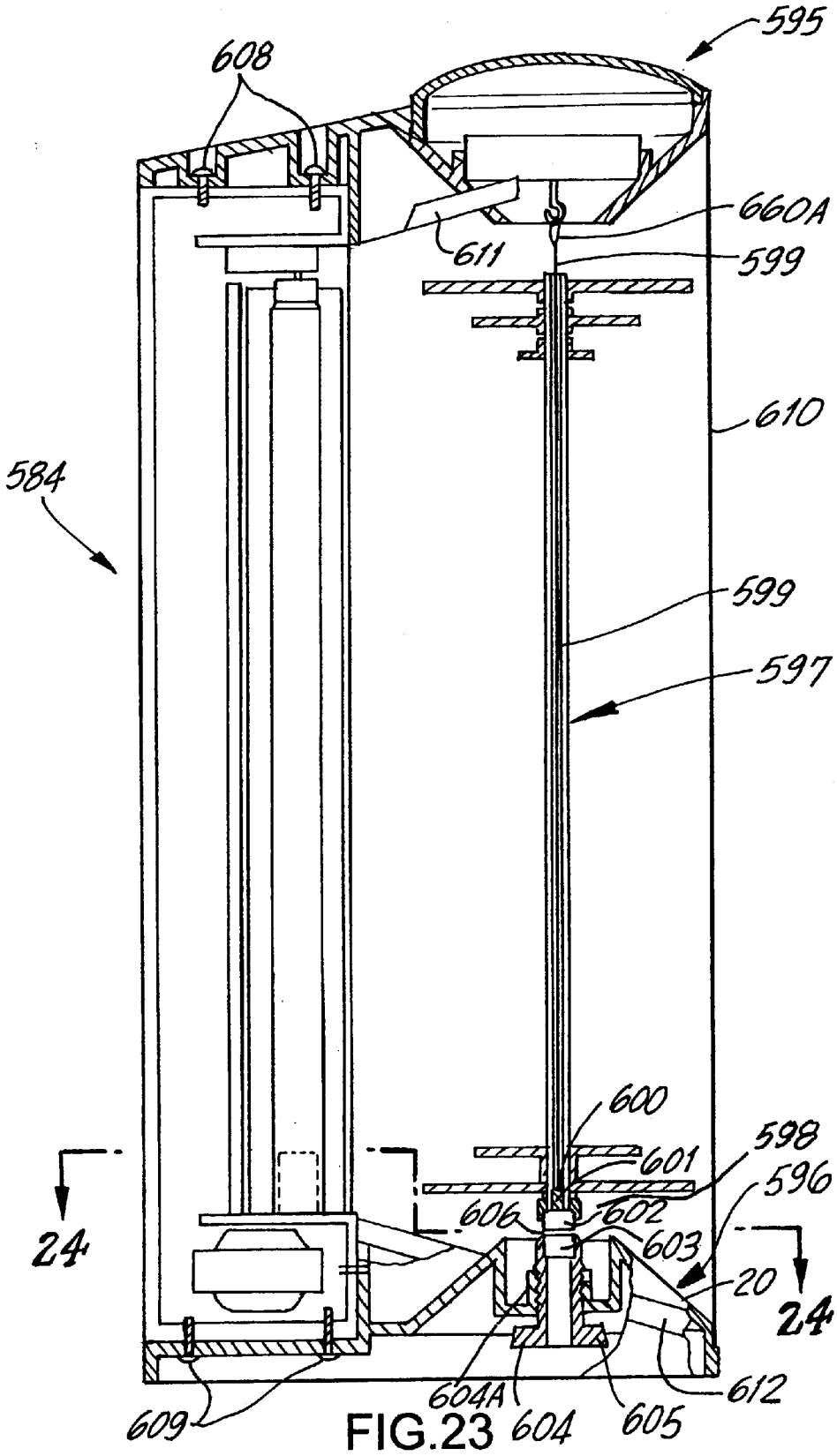
FIG. 23 is a view similar to FIGS. 21 but with attachable kinetic elements and having a magnetically tensioned spindle according to a further embodiment of the invention.
Figure 24:
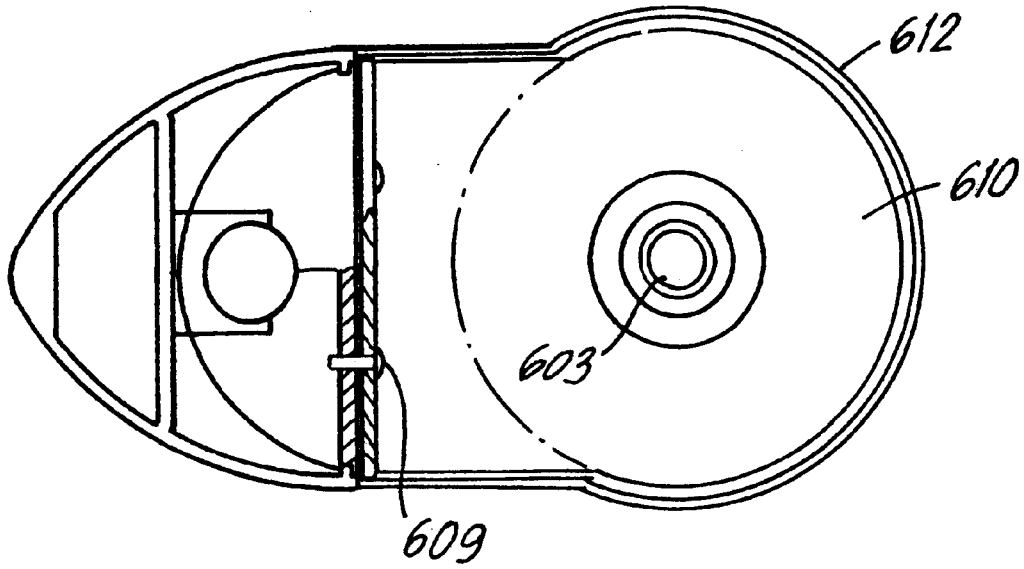
FIG. 24 is a sectional view along the line 24—24 of the display device shown in FIG. 23.

FIGS. 23 and 24 illustrate a simple black light fixture identical to the one shown in FIG. 21 but with the upper and lower string frames illustrated in FIGS. 21 and 22 removed and replaced with an attached upper kinetic spindle mounted module 595 and an attached lower kinetic spindle mounting module 596.

In addition to illustrating a modular system the lamp of FIG. 23 incorporates a device for magnetic tensioning of the spindle, which by essentially eliminating friction at one bearing point, allows the spindle to spin much faster and enables some degree of control over the speed of rotation independent of the motor impelling the spin.

The upper spindle mounting module is identical in function and similar in structure to that of the motor housing of FIG. 1. The lower spindle mounting module of FIG. 23 differs markedly from that of the base of the lamp of FIG. 1. The spindle 597 of the lamp of FIG. 23 differs from the spindle of the lamp of FIG. 1 and the spindle of FIG. 10 in order to effect a magnetic tensioning of the spindle to increase its speed of rotation and control that speed. The magnetic tensioning area 598 is comprised of elements of the lamp base and elements of the bottom of the spindle.

Unlike the previous spindle the spindle of FIG. 23 is suspended by two lengths of monofilament line 599 forming a top loop 660A and attached through eye hole 600 of the bottom magnetic mounting fixture 601 of the spindle. Press fit into this fixture is a strong ceramic magnet 602 identical to that of the common refrigerator door latch magnet and below this magnet is mounted a matching magnet (603) oriented so that the magnets are mutually attracting with this magnet being press fit into the tip of a threaded plastic height adjusting screw (604) this screw being threaded into the thread base bore 604A of the lower kinetic spindle module and being easily twisted to adjust height of the magnet by means of the screw flange 605. The lower magnet is lowered until the spindle is held in tension but with a small air gap 606 (on the order of ⅛ to 1/16 of an inch) between the two magnets when the spindle is completely unwound. The spindle is thus held rigidly and in a stable manner as if it had an axle at the bottom as in FIG. 10. The pull between the two magnets increases the apparent weight of the spindle without increasing its mass or rotational inertia. This enables the spindle to spin faster than it would if the tension on the wound up monofilaments were only a function of the mobiles weight.

The upper kinetic spindle mounting module is attached by screws 608 and the lower kinetic spindle mounting module by screws 609. As with other versions of the invention, this lamp of FIG. 23 comes with an optional UV blocking cover 610 removable mounted to upper and lower sills 611 and 612.

Figure 25:
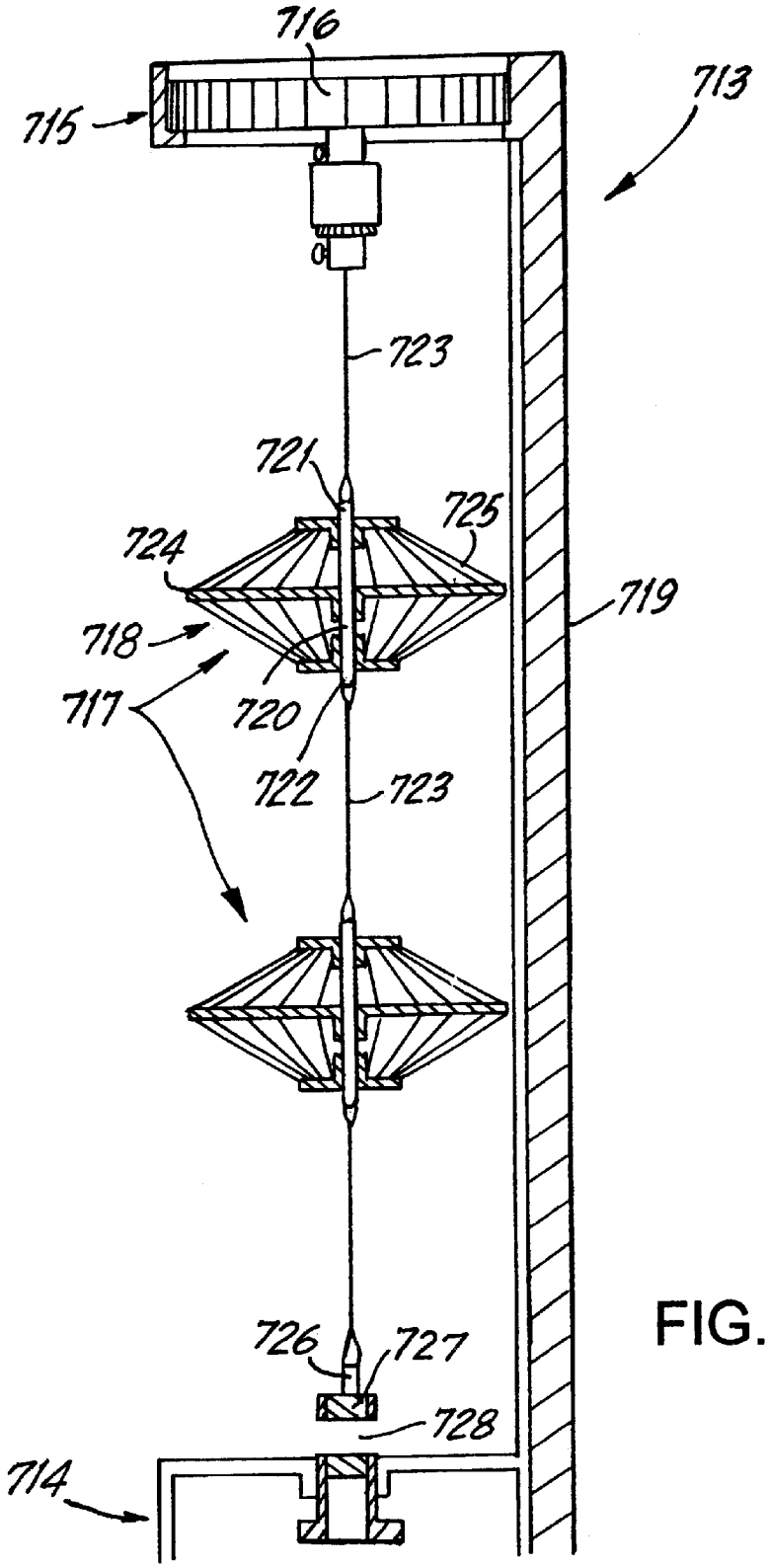
FIG. 25 is a longitudinal sectional view showing a magnetically tensioned spindle comprised of multiple spindle assemblies (mini spindles).

FIG. 25 illustrates a variation on the magnetically tension spindle illustrated in FIG. 23. It is mounted independently of a UV light fixture to illustrate the importance of the tensioning feature in its own right and for simplicity sake. The independent mobile 713 is comprised of a simple base 714 and a top motor mount 715 and motor 716 identical to that of the motor of FIG. 23; a spindle train (717) comprised of one or more minispindles (718), and simple stiff vertical support member 719, the spindle train being magnetically tensioned in a similar manner to that of the spindle of FIG. 23.

Each minispindle is comprised of a central transparent solid plastic axle 720 with top and bottom threading holes 721,722 and suspended on line by means of intermittent monofilament (723). Press fitted on this axle are typical spindle frame disks 724 threaded with typical fluorescent threads is (725). Suspended from the bottom of the monofilament is a hanging magnet mount 726 with a refrigerator magnet 727 press fitted in it. It is in close proximity to the base magnet 728 and in attractive orientation. Thus the monofilament is held taught and axially stable by means of this attraction.

With the spindle assembly mounted to the motor in the same fashion as in FIG. 23, a spindle train with more than one minispindle will have interesting decorative variation from the single rigid spindle in that the minispindles will be slightly out of sink with each other with the lower minispindles lagging behind the upper minispindles as the monofilament is twisted clockwise and counterclockwise.

Figure 26:
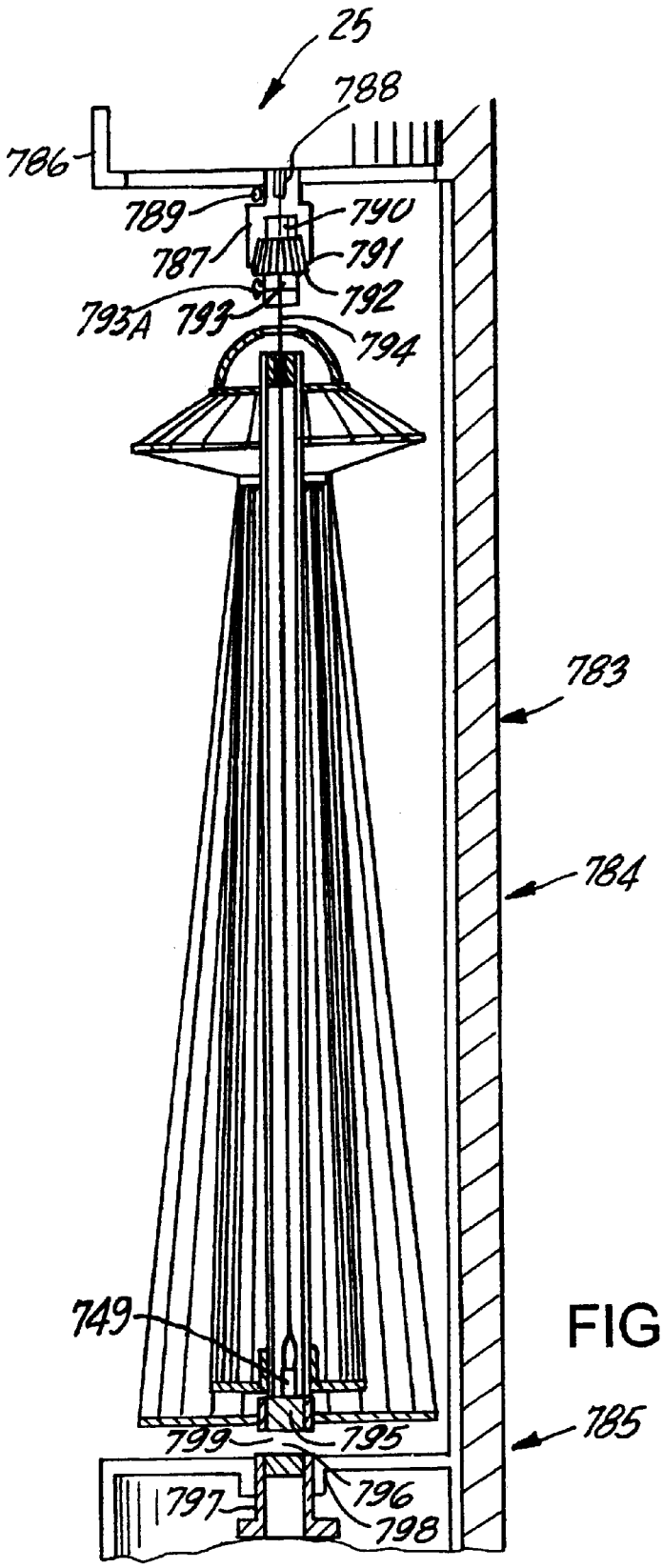
FIG. 26 is a longitudinal sectional view showing another spindle assembly.

FIG. 26 is a longitudinal section of a stand-alone mobile 783 the elements of which are similar to the lamp of FIG. 1. This configuration allows the spindle to spin much more rapidly in the alternating direction of spin situation. The stand alone mobile further comprises a vertical support beam 784, a base 785, and an upper support ring 786 which holds the motor unit 25.

The spindle shown in FIG. 26 is nearly identical to that of FIG. 10 but is joined and stabilized magnetically by means of axles and hooks. Instead of a hook, a female spline 787 is attached to the motor axle 788 by means of screw 789. A common ceramic magnet 790 is press fitted into its center. Likewise an identical magnet, the upper spindle magnet 791 set in attracting orientation to the first magnet is press fitted into the matching male spline 792. The magnets abut each other with the splines engaged but not so tightly as to bind as in a tapered press fit. The upper end of the monofilament line 794 is threaded through a central hole 793 of the male spline and secured by means of a screw 793A. Thus, the entire spindle is suspended by means of the two upper magnets in their attracting relationship. The splines prevent rotational slippage as the motor spins alternately clockwise and counterclockwise. At the same time the entire spindle may be removed by pulling down and disengaging the magnets.

The rate of spin of the spindle is determined by how twisted the monofilament is and how hard it is pulled down. Typically, this is simply the weight of the spindle as a whole. However, by increasing this weight without increasing the mass (which adds momentum, which slows the rate of spin) then the rate of spin can be increased. This is accomplished by means of two additional magnets. A lower spindle magnet 795 is press fitted into the bottom shaft fitting 749. A second magnet in attracting orientation, the base magnet 796 is press fitted into a level adjustment screw 797. This screw is centered axially to the spindle within a central threaded hole 798. With the spindle mounted but at rest with the monofilament line untwisted and thus at its longest, the base magnet is screwed up to close proximity with the bottom spindle magnet, but leaving an air gap 799. The resulting attraction acts as a stabilizing axle and adds "weight" without adding mass due to the attraction of the two magnets. If the base magnet is screwed up too close to the lower spindle magnet then of course they will bind, but the upper layer of the screw prevents the bottom two magnets from coming together completely as are the upper two magnets. Thus the spindle will not be pulled loose from its upper mount if all four magnets are identical. As the monofilament ages, it will of course stretch some, but the base magnet merely has to be lowered a bit by means of the level adjustment screw to restore the proper gap. By adjusting the gap between the bottom two magnets the rate of spin of the spindle can be tuned to maximize the high end of the spin cycle.

Figure 27:
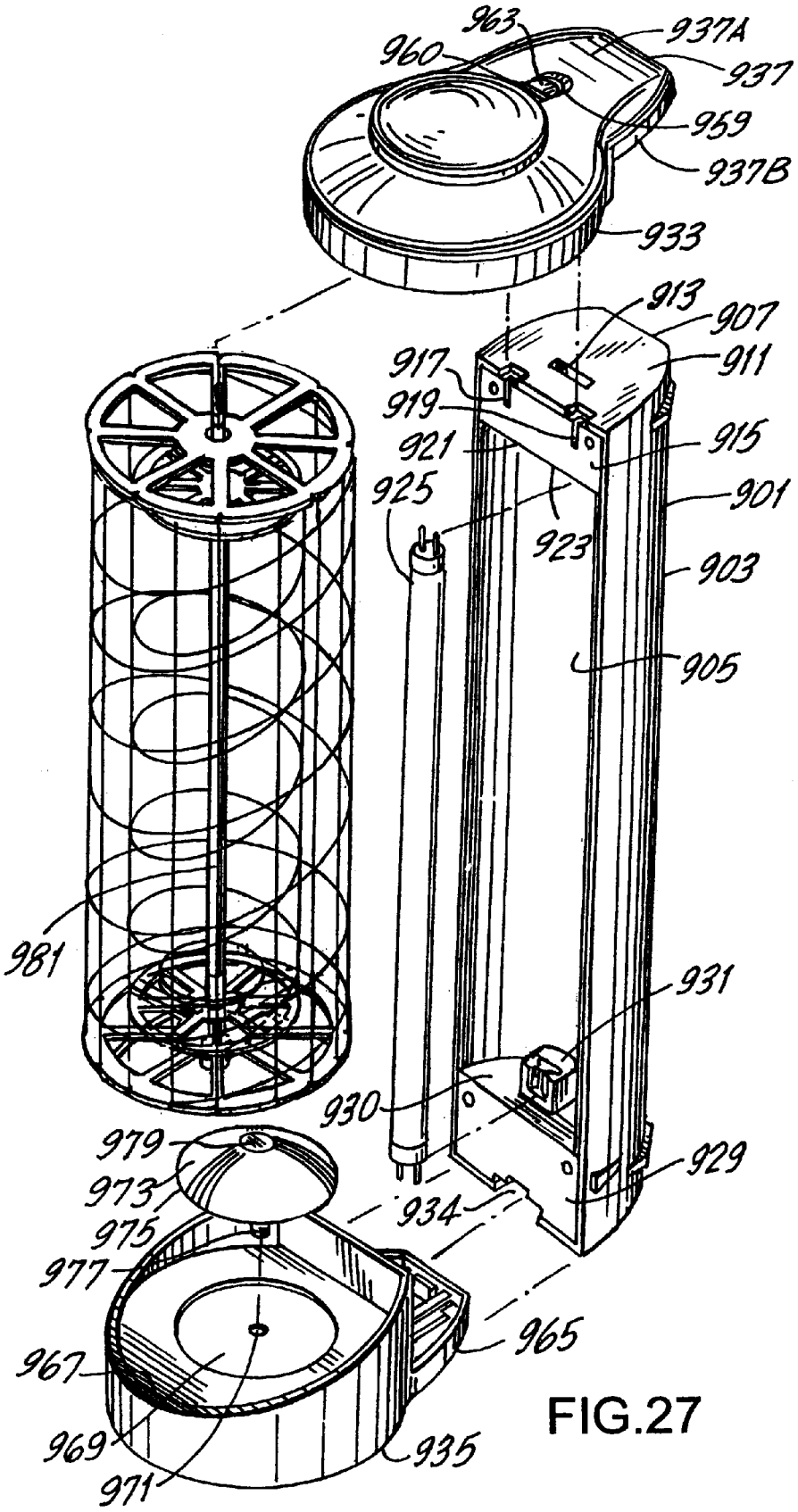
FIG. 27 is an exploded perspective view of a black light display device according to another embodiment of the present invention.
Figure 28:
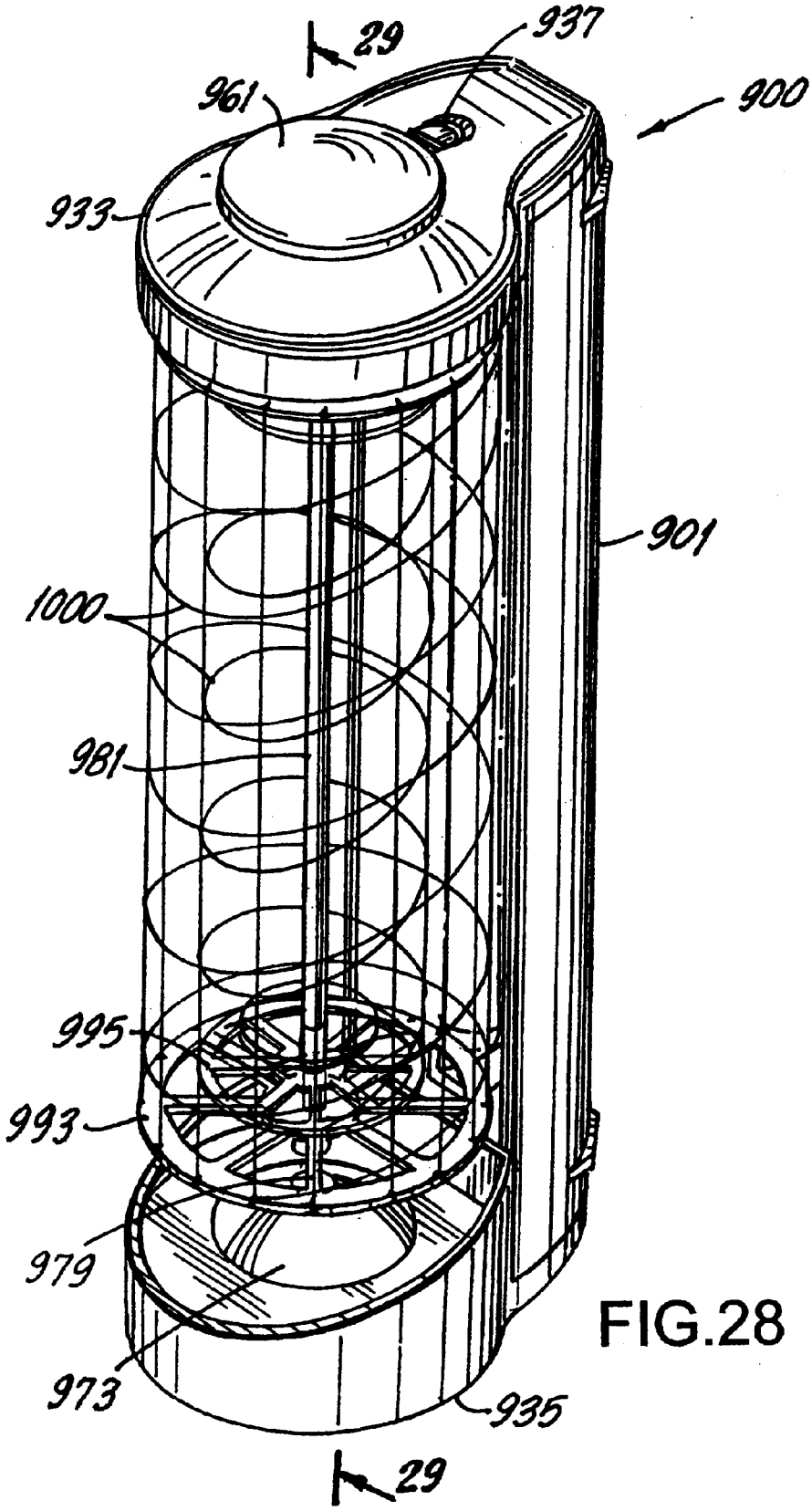
FIG. 28 is a perspective view of the black light display device shown in FIG. 27.
Figure 29:
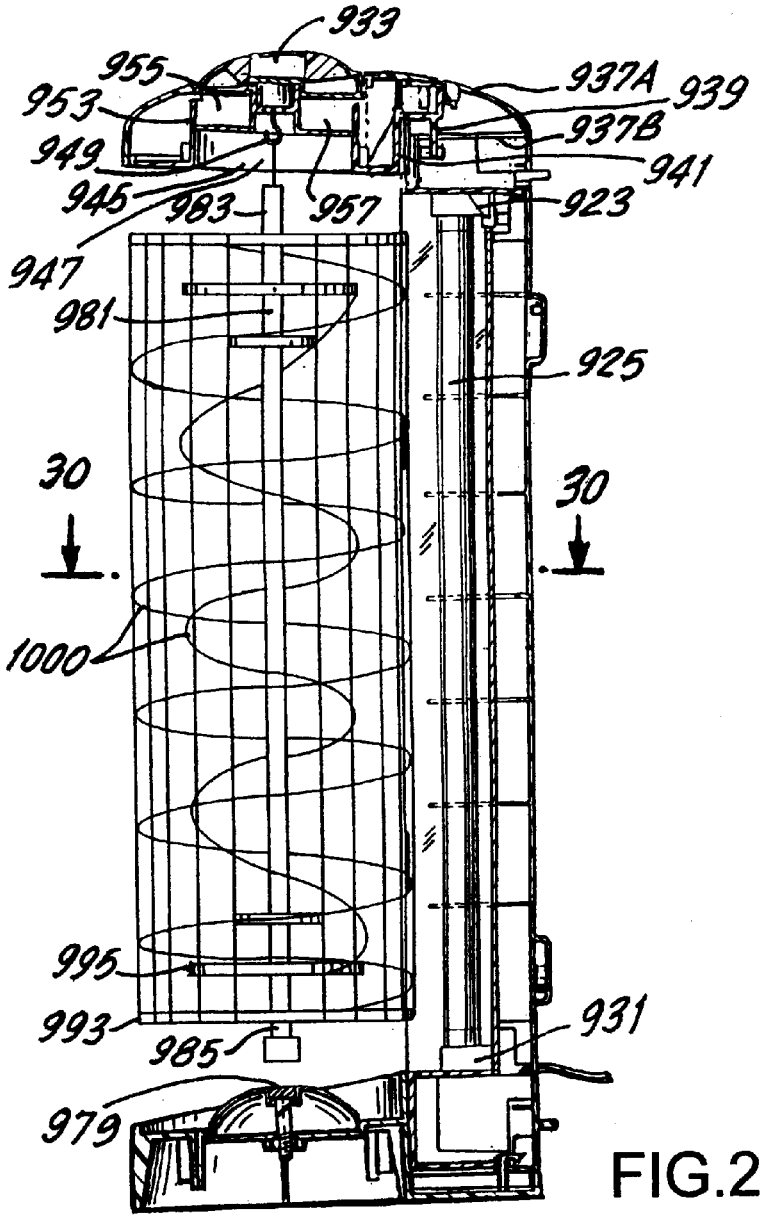
FIG. 29 is a vertical view of the black light display device shown in FIG. 28 taken along the line 29—29.
Figure 30:
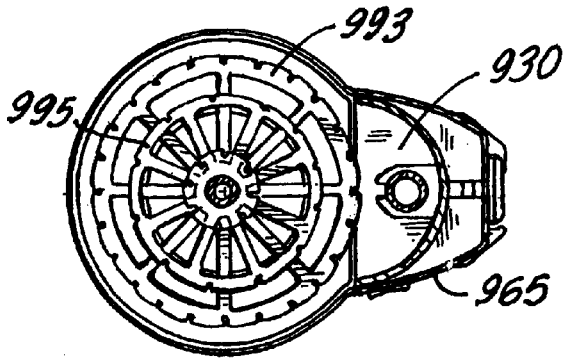
FIG. 30 is a cross sectional view taken along the line 30—30 of FIG. 29.
Figure 31:
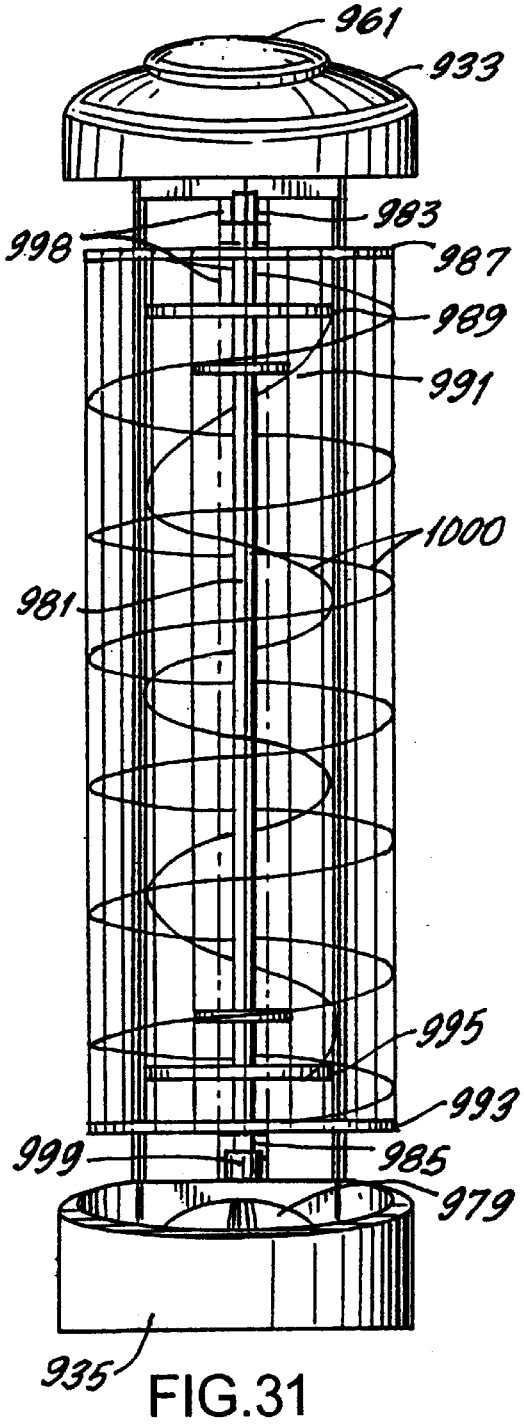
FIG. 31 is a front view of the black light display device shown in FIG. 28.
Figure 32:
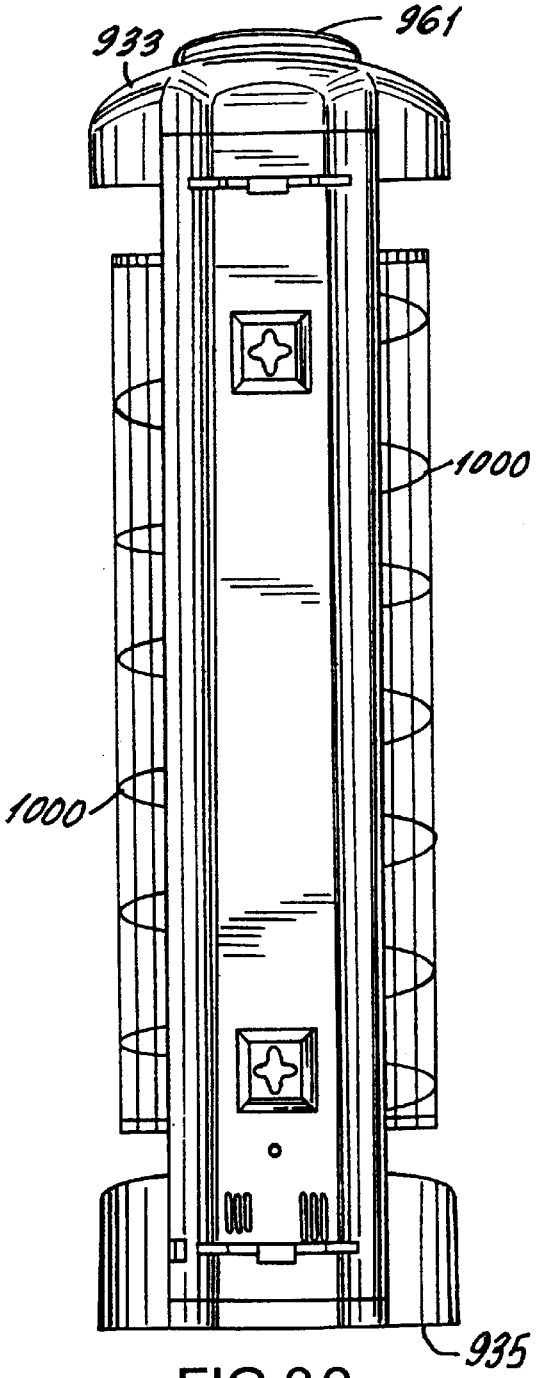
FIG. 32 is a rear view of the black light display device shown in FIG. 28.
Figure 33:
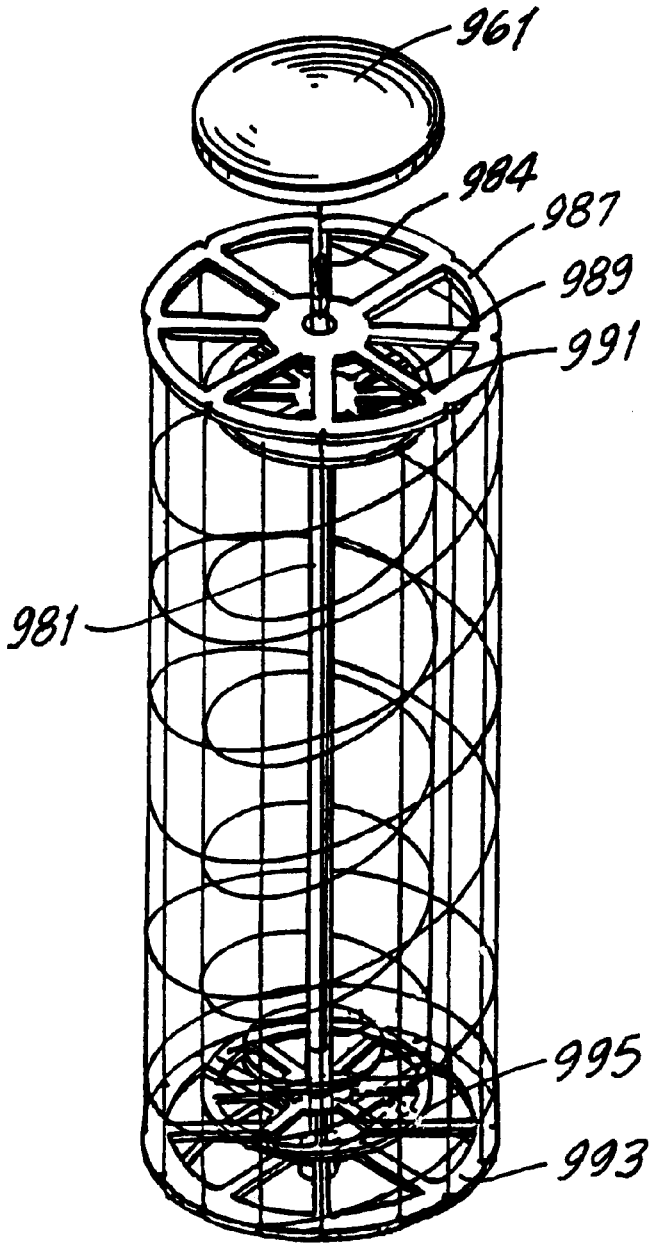
FIG. 33 is a perspective view similar to FIG. 28 showing the spindle and fluorescent thread assembly with the top removed to illustrate another mode of securing the spindle.
Figure 34:
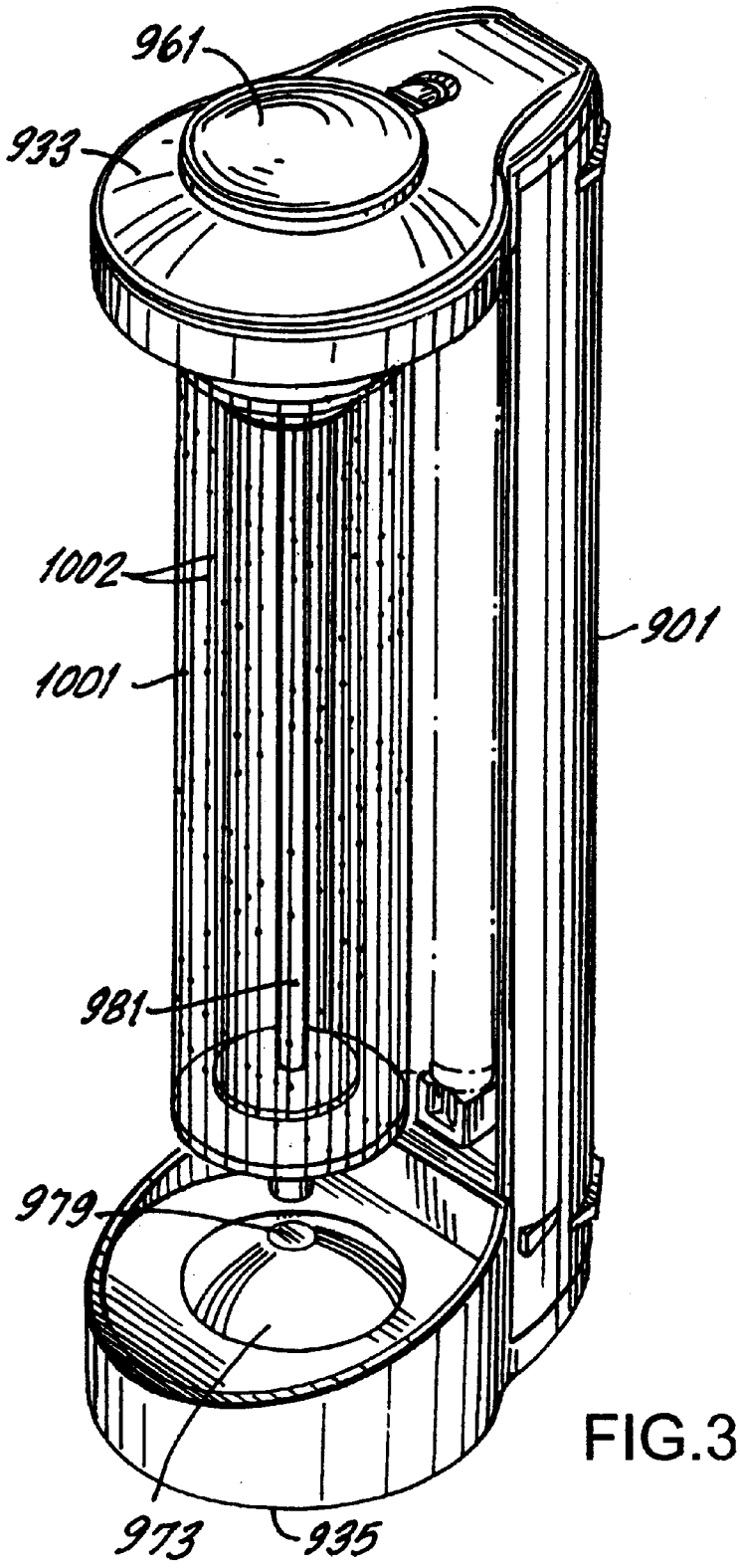
FIG. 34 is a view similar to FIG. 28 but illustrating a different spindle fluorescent thread assembly.

Referring to the embodiment illustrated in FIGS. 27–34, particularly first to FIGS. 27 and 28, the black light display device generally designated as 900 comprises a vertical frame 901 having an outer surface 903 and generally concave reflective inner surface 905. The frame 901 has a top portion 907 and bottom portion 909. The top portion 907 comprises a horizontal top plate or surface 911 having a slot 913, and a vertical plate member 915 having a pair of spaced apart slots 917,919 and a bottom plate or surface 930 having a means such as a socket 923 for securing the upper end of the lamp 925 therein. The bottom portion 909 comprises a bottom horizontal plate or surface 927, a vertical plate member 929 and a top plate surface 929 having a means such as a socket 931 aligned with the socket 923 for securing the other ends of the lamp 925 within the housing 901.

A top plate member 933 is removably mounted on top of the housing 901 and a bottom plate member 935 is removably secured to the bottom of said housing. The top plate member 933 has a laterally projecting segment 937 having a top surface 937A and a lower surface 937B. The lower surface 937B has a central latch 939 (see FIG. 29) which fits securely into the slot 913 and a pair of laterally disposed latches 941,943 adapted to fit securely into the slots 917,919, respectively. The top plate member 933 comprises a lower surface 945 having a central recess 947 from which hangs a hook means 949. The upper surface 951 of the plate member 933 comprises a central recessed housing 953 having two battery compartments 955,957. The recessed housing has a projecting slot 959 for engagement by a latch 960 which extends from a dome-shaped plate 961 used to cover the recessed housing 947. A push button 963 actuates the batteries in the housing by means of electrical connection (not shown).

The bottom plate 935 comprises a projecting segment 965 which can be slidably inserted into the slot 934 in the bottom horizontal plate 927, to be secured therein. The bottom plate 935 comprises an upper surface 967 having a generally circular recess 969 with a threaded central hole 971. A dome-shaped plate 973 having a concave inner surface 975 covers the central recess 969 by means of a threaded screw 977 which threadedly engages the threaded central hole 971. A magnet 979 is disposed at the apex of the dome 973 for actuating the spindle 981 which is freely mounted from the latch 949.

As shown in FIGS. 27–29 and 31, the spindle 981 has its upper end 983 hanging from the latch 949 by a wire loop 984 and its lower end 985 hangs freely above the magnet 979 which serves to rotatably bias the spindle 981 and hold it in a substantially vertical orientation. Also shown in these figures is a string or wire assembly advantageously fluorescent, which comprises three circular top frames 987, 989,991 and two circular bottom frames 993,995. Each of the circular frames are preferably coaxially positioned, and comprises a central disc, which is radially secured to perimeter of each frame and each disc has a central aperture wherein the apertures in all the discs are axially aligned for passage of the spindle 981 therethrough. The collar portion 998 serves to securely retain the spindle through said apertures in the discs of the upper frame member and the collar portion 999 serves to securely retain the spindle through the apertures in the discs in the lower frame members. Of course, other known means may be used to retain the spindle between top and bottom of the assembly.

Geometrically configured fluorescent wires, threads or strings 1000 are secured between corresponding top and bottom frames of the string assembly. Thus, as shown in the drawings, the wires, threads or strings 1000 are strung around the spindle 981 between the corresponding upper 987, 989 and 991 and lower frames 993 and 995 of the assembly. These threads, which may be in a variety of colors, can assume different geometrical configurations such as spiral or s-shape, or any combination thereof. In the embodiment shown in FIG. 34, the threads 1001 are strung vertically and comprise fluorescent dots 1002 or specs patterned to produce any desired geometrical configuration and glow when energized by the black light member.

While different embodiments of the invention have been described in detail it must be understood that various obvious simplifications and/or modifications can be made in the display device of this invention which are apparent from the foregoing detailed description. Such simplifications and modifications are nevertheless within the scope and contemplation of the present invention.

What is claimed is:

1. A black light display device comprising a fixture having a vertical axis defined by two opposed vertically oriented front and rear walls, two opposed vertically oriented side walls, a top closure wall and a bottom closure wall, wherein at least one of said vertically oriented walls is removable and transparent to visible light, a black light element disposed interiorly of said walls, a spindle assembly comprising a spindle member having top and bottom ends and removably mounted vertically between said top closure wall and said bottom closure wall, at least one frame disk mounted radially on said spindle member and a plurality of fluorescent elements formed about said at least one frame disk, wherein said fluorescent elements are adapted to be energized by said black light element to display a visible glow.

2. A black light display device as in claim 1 wherein each of said transparent wall is made of a plastic material which prevents passage therethrough of ultraviolet light radiating from said black light element but permits passage of visible light.

3. A black light display device as in claim 2, wherein said spindle assembly is rotatably mounted and further comprising a motor wherein said spindle assembly is actuated by said motor.

4. A black light display device as in claim 1 further comprising an upper frame member attached interiorly to said top closure wall and a lower frame attached interiorly to said bottom closure wall, and wherein said spindle assembly has an upper end secured to said upper frame member and a lower end secured to said lower frame member.

5. A black light display device as in claim 4 wherein each of said transparent wall is made of a plastic material which prevents passage therethrough of ultraviolet light radiating from said black light element but permits the passage of visible light.

6. A black light display device as in claim 4, wherein said spindle assembly is rotatably mounted and further comprising a motor wherein said spindle assembly is actuated by said motor.

7. A black light display device as in claim 6 further comprising a magnetic tension control means operatively associated with said bottom end of said spindle member for controlling variation on tension of the spindle member.

8. A black light display device as in claim 4 further comprising a magnetic tension control means operatively associated with said bottom end of said spindle member for controlling variation on tension of the spindle member.

9. A black light display device as in claim 4 wherein said spindle assembly is spinably mounted.

10. A black light display device as in claim 4 wherein each of said fluorescent elements is in the form of a disk mounted vertically on said spindle member in spaced apart relationship relative to each other.

11. A black light display device as in claim 4 further including fluorescent elements is in the form of disks mounted vertically on said spindle member in spaced apart relationship relative to each other.

12. A black light display device as in claim 1, wherein said spindle assembly is rotatably mounted and further comprising a motor wherein said spindle assembly is actuated by said motor.

13. A black light display device as in claim 12 wherein each of said fluorescent elements is in the form of a disk mounted vertically on said spindle member in spaced apart relationship relative to each other.

14. A black light display device as in claim 12 further including fluorescent elements is in the form of disks mounted vertically on said spindle member in spaced apart relationship relative to each other.

15. A black light display device as in claim 1 further comprising a magnetic tension control means operatively associated with said spindle member for controlling variation on tension of the spindle member.

16. A black light display device as in claim 1 wherein said spindle assembly member is spinnably mounted.

17. A black light display device as in claim 1 wherein each of said fluorescent elements is in the form of a disk mounted vertically on said spindle member in spaced apart relationship relative to each other.

18. A black light display device as in claim 1 wherein each of said fluorescent elements is in the form of string elements mounted vertically on said frame disk in spaced apart relationship relative to each other.

19. A black light display device as in claim 1 wherein said black light element is disposed interiorly adjacent to one of said transparent walls.

20. A black light display device as in claim 1 wherein said black light element is disposed interiorly adjacent to one of said removable walls.

21. The black light display device as in claim 1 comprising at least two frame disks spaced apart along said spindle member.

22. The black light display device as in claim 1 comprising at least two frame disks having different diameters.

23. The black light display device as in claim 1 wherein said fluorescent elements if comprise a plurality of strings and each of said frame disk having a radial edge with at least one notch for receiving said strings to be formed about said frame disks.

24. A vertical black light display device comprising:

(a) at least one vertically disposed wall having a top end and a bottom end;

(b) a vertically disposed black light member adjoining said wall and having a top end and a bottom end;

(c) a top member attached to said top end of said wall;

(d) a bottom member attached to said bottom end of said wall;

(e) a removable spindle assembly comprising a spindle member having a top end and a bottom end and disposed between said top member and said bottom member and further being spaced from said vertical black light member, (f) at least two frame disks mounted radially and spaced apart on said spindle member; and (g) a fluorescent string element retained between said at least two frame disks and adapted to be energized by said vertical black light member to display visible glow.

25. A vertical black light member as in claim 24 wherein said spindle assembly is rotatably secured to said top member.

26. A black light display device as in claim 25 further comprising a magnetic tension control means operatively associated with said spindle member for controlling variation on tension of the spindle member.

27. A black light display device as in claim 25 further including fluorescent elements is in the form of disks mounted vertically on said spindle member in spaced apart relationship relative to each other.

28. A black light display device as in claim 25 further including fluorescent elements is in the form of disks mounted vertically on said spindle member in spaced apart relationship relative to each other.

29. A vertical black light member as in claim 24 wherein said spindle assembly is detachably secured to said top member.

30. A black light display device as in claim 24 further comprising a magnetic tension control means operatively associated with said spindle member for controlling variation on tension of the spindle member.

31. A black light display device as in claim 24 wherein said spindle assembly is spinnably mounted.

32. A black light display device as in claim 24 further including fluorescent elements is in the form of disks mounted vertically on said spindle member in spaced apart relationship relative to each other.

33. A black light display device as in claim 24 further including fluorescent elements is in the form of disks mounted vertically on said spindle member in spaced apart relationship relative to each other.

34. A vertical black light display device comprising:

(a) a vertically disposed black light member having a top end and a bottom end;

(b) a top member attached to the top end of said vertical black light member;

(c) a bottom member attached to the bottom end of said black light member;

(d) a removable spindle assembly comprising a spindle member disposed between said top member and said bottom member spaced from said vertical black light member, (e) at least two frame disks mounted radially and spaced apart on said spindle member, and (f) at least one fluorescent string element retained between said at least two frame disks adapted to be energized by said vertical black light member to display visible glow.

35. A vertical black light member as in claim 34 wherein the top member is detachably mounted to the top of said vertical black light member and the bottom member is detachably mounted to the bottom of said vertical black light member.

36. A vertical black light display device as in claim 34 wherein said spindle assembly is rotatably secured to said top member.

37. A vertical black light member as in claim 35 wherein said spindle member is detachably secured to said top member.

38. A vertical black light member as in claim 34 wherein said top member comprises a battery source for energizing said spindle member.

39. A vertical black member device as in claim 34 wherein said bottom member comprises a magnetic element for magnetically biasing said spindle member.

40. A vertical black light member as in claim 39 further including top and bottom frames spaced apart and secured to said spindle, said string element secured and extending between said top and bottom frames to form a geometric design.

41. A vertical black light display device as in claim 34 comprising geometrically configured fluorescent elements disposed around said spindle member.

42. A vertical black light display device as in claim 41 wherein said fluorescent elements are in different colors.

43. A vertically black light display device as in claim 41 wherein said fluorescent elements comprise multi-colored geometrically pre-arranged specs adapted to be energized by said black light member to exhibit visible colors.

44. A vertical black light display device as in claims 34, 36, 41, 42 or 43 wherein said fluorescent elements are energized by said black light by alternating current.

45. A vertical black light display device as in claim 43 wherein said spindle assembly is rotatably clockwise then counterclockwise in sequence.

46. A vertical black light display device as in claim 41 wherein said spindle assembly is rotatable.

* * * * *